US011560280B2

(12) United States Patent
Funaki et al.

(10) Patent No.: US 11,560,280 B2
(45) Date of Patent: Jan. 24, 2023

(54) MEDIUM CONVEYING APPARATUS FOR DETERMINING CONVEYANCE ABNORMALITY BASED ON DETERMINATION RESULT OF FLOATING AND SKEW OF MEDIUM

(71) Applicant: PFU LIMITED, Kahoku (JP)

(72) Inventors: Ken Funaki, Kahoku (JP); Tomoyuki Niwata, Kahoku (JP); Hiroyuki Kitano, Kahoku (JP)

(73) Assignee: PFU LIMITED, Ishikawa (JP)

( * ) Notice: Subject to any disclaimer, the term of this patent is extended or adjusted under 35 U.S.C. 154(b) by 136 days.

(21) Appl. No.: 17/167,679

(22) Filed: Feb. 4, 2021

(65) Prior Publication Data

US 2021/0253387 A1 Aug. 19, 2021

(30) Foreign Application Priority Data

Feb. 19, 2020 (JP) ..... JP2020-026451

(51) Int. Cl.

| | |
|---|---|
| ***B65H 7/06*** | (2006.01) |
| ***B65H 1/04*** | (2006.01) |
| ***B65H 3/06*** | (2006.01) |
| ***B65H 7/14*** | (2006.01) |

(52) U.S. Cl.

CPC ..... *B65H 7/06* (2013.01); *B65H 1/04* (2013.01); *B65H 3/06* (2013.01); *B65H 7/14* (2013.01); *B65H 2301/44324* (2013.01); *B65H 2553/414* (2013.01); *B65H 2801/06* (2013.01); *B65H 2801/39* (2013.01)

(58) Field of Classification Search

CPC ... B65H 7/06; B65H 1/04; B65H 3/06; B65H 7/14; B65H 2301/44324; B65H 2553/414; B65H 2801/06; B65H 2801/39

See application file for complete search history.

(56) References Cited

U.S. PATENT DOCUMENTS

| | | | | |
|---|---|---|---|---|
| 2017/0359475 | A1* | 12/2017 | Xie | H04N 1/00628 |
| 2017/0366696 | A1* | 12/2017 | Koyanagi | B65H 3/0653 |
| 2018/0176399 | A1* | 6/2018 | Umi | B65H 5/06 |
| 2018/0215564 | A1 | 8/2018 | Matsumura | |

FOREIGN PATENT DOCUMENTS

| | | | |
|---|---|---|---|
| JP | 2016-169104 | A | 9/2016 |
| JP | 2017-147605 | A | 8/2017 |
| JP | 2018-122950 | A | 8/2018 |

* cited by examiner

*Primary Examiner* — Thomas A Morrison

(74) *Attorney, Agent, or Firm* — Lewis Roca Rothgerber Christie LLP

(57) ABSTRACT

A medium conveying apparatus includes a floating sensor located on an upstream side of a first roller in the medium conveying direction to detect a floating of the medium placed on a medium tray, a skew sensor located on a downstream side of a second roller in the medium conveying direction to detect a skew of the medium conveyed by the second roller, and a processor to determine whether the floating of the medium has occurred based on an output signal from the floating sensor, determine whether the skew of the medium has occurred based on an output signal from the skew sensor, and determine that a conveyance abnormality of the medium has occurred when the processor determines that the floating of the medium has occurred and the processor determines that the skew of the medium has occurred.

20 Claims, 18 Drawing Sheets

MEDIUM CONVEYING APPARATUS FOR DETERMINING CONVEYANCE ABNORMALITY BASED ON DETERMINATION RESULT OF FLOATING AND SKEW OF MEDIUM

CROSS-REFERENCE TO RELATED APPLICATIONS

This application is based upon and claims the benefit of priority of prior Japanese Patent Application No. 2020-26451, filed on Feb. 19, 2020, the entire contents of which are incorporated herein by reference.

TECHNICAL FIELD

Embodiments discussed in the present specification relate to convey a medium.

BACKGROUND

A medium conveying apparatus such as a scanner has a function of separating and feeding a plurality of media. However, when the medium folded in two or the stapled media, etc., is conveyed with the function of separating and feeding the plurality of media enabled, the medium is not separated, and a conveyance abnormality such as a jam (paper jam) may occur.

The medium conveying apparatus needs to accurately determine whether or not a medium conveyance abnormality has occurred in order to stop the medium conveyance to prevent damaging to the medium when the medium conveyance abnormality occurs.

A feeding apparatus to determine a feeding abnormality of a sheet when an amount of deformation (bounce amount) of a fed sheet is equal to or more than a determination threshold value, is disclosed (Japanese Unexamined Patent Application Publication (Kokai) No. 2016-169104). This feeding apparatus corrects the determination threshold value in accordance with a change in an oblique amount of a tip of the sheet.

An image reading apparatus including a jump detection unit to detect a jump of a document and a multi-feed detection unit to detect a multi-feed of the document, and determines whether or not a staple process is performed on the document based on the detection results of the jump detection unit and the multi-feed detection unit, is disclosed (Japanese Unexamined Patent Application Publication (Kokai) No. 2017-147605).

SUMMARY

According to some embodiments, a medium conveying apparatus includes a medium tray, a first roller to feed by separating a medium placed on the medium tray, a second roller located on a downstream side of the first roller in a medium conveying direction to convey the medium fed by the first roller to the downstream side in the medium conveying direction, a floating sensor located on an upstream side of the first roller in the medium conveying direction to detect a floating of the medium placed on the medium tray, a skew sensor located on a downstream side of the second roller in the medium conveying direction to detect a skew of the medium conveyed by the second roller, and a processor to determine whether the floating of the medium has occurred based on an output signal from the floating sensor, determine whether the skew of the medium has occurred based on an output signal from the skew sensor, and determine that a conveyance abnormality of the medium has occurred when the processor determines that the floating of the medium has occurred and the processor determines that the skew of the medium has occurred.

According to some embodiments, a method for determining a conveyance abnormality of a medium includes feeding by separating a medium placed on a medium tray, by a first roller, conveying the medium fed by the first roller to the downstream side in the medium conveying direction by a second roller located on a downstream side of the first roller in a medium conveying direction, detecting a floating of the medium placed on the medium tray, by a floating sensor located on an upstream side of the first roller in the medium conveying direction, detecting a skew of the medium conveyed by the second roller, by a skew sensor located on a downstream side of the second roller in the medium conveying direction, determining whether the floating of the medium has occurred based on an output signal from the floating sensor, determining whether the skew of the medium has occurred based on an output signal from the skew sensor, and determining that a conveyance abnormality of the medium has occurred when it is determined that the floating of the medium has occurred and it is determined that the skew of the medium has occurred.

According to some embodiments, a computer-readable, non-transitory medium stores a computer program. The computer program causes a medium conveying apparatus including a medium tray, a first roller to feed by separating a medium placed on the medium tray, a second roller located on a downstream side of the first roller in a medium conveying direction to convey the medium fed by the first roller to the downstream side in the medium conveying direction, a floating sensor located on an upstream side of the first roller in the medium conveying direction to detect a floating of the medium placed on the medium tray, and a skew sensor located on a downstream side of the second roller in the medium conveying direction to detect a skew of the medium conveyed by the second roller, to execute a process. The process includes determining whether the floating of the medium has occurred based on an output signal from the floating sensor, determining whether the skew of the medium has occurred based on an output signal from the skew sensor, and determining that a conveyance abnormality of the medium has occurred when it is determined that the floating of the medium has occurred and it is determined that the skew of the medium has occurred.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
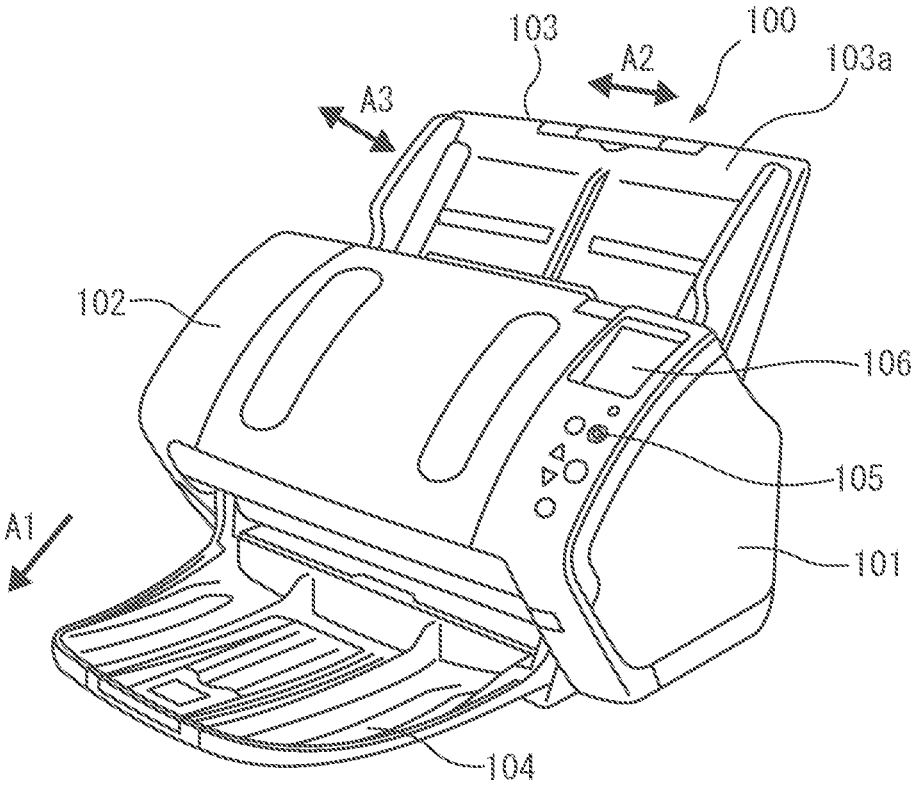
FIG. 1 is a perspective view illustrating a medium conveying apparatus 100 according to the embodiment.

FIG. 1 is a perspective view illustrating a medium conveying apparatus 100 configured as an image scanner. The medium conveying apparatus 100 conveys and images a medium being a document. The medium is a paper, a card, a booklet, etc. The paper includes thin paper or cardboard, etc. The booklet includes a passport or a passbook, etc. The medium conveying apparatus 100 may be a fax machine, a copying machine, a multifunctional peripheral (MFP), etc. A conveyed medium may not be a document but may be an object being printed on, etc., and the medium conveying apparatus 100 may be a printer, etc.

The medium conveying apparatus 100 includes a lower housing 101, an upper housing 102, a medium tray 103, an ejection tray 104, an operation device 105, and a display device 106.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

The medium tray 103 is engaged with the lower housing 101 in such a way as to be able to place a medium to be conveyed. The medium tray 103 has a placing surface 103*a* on which a medium is placed. The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
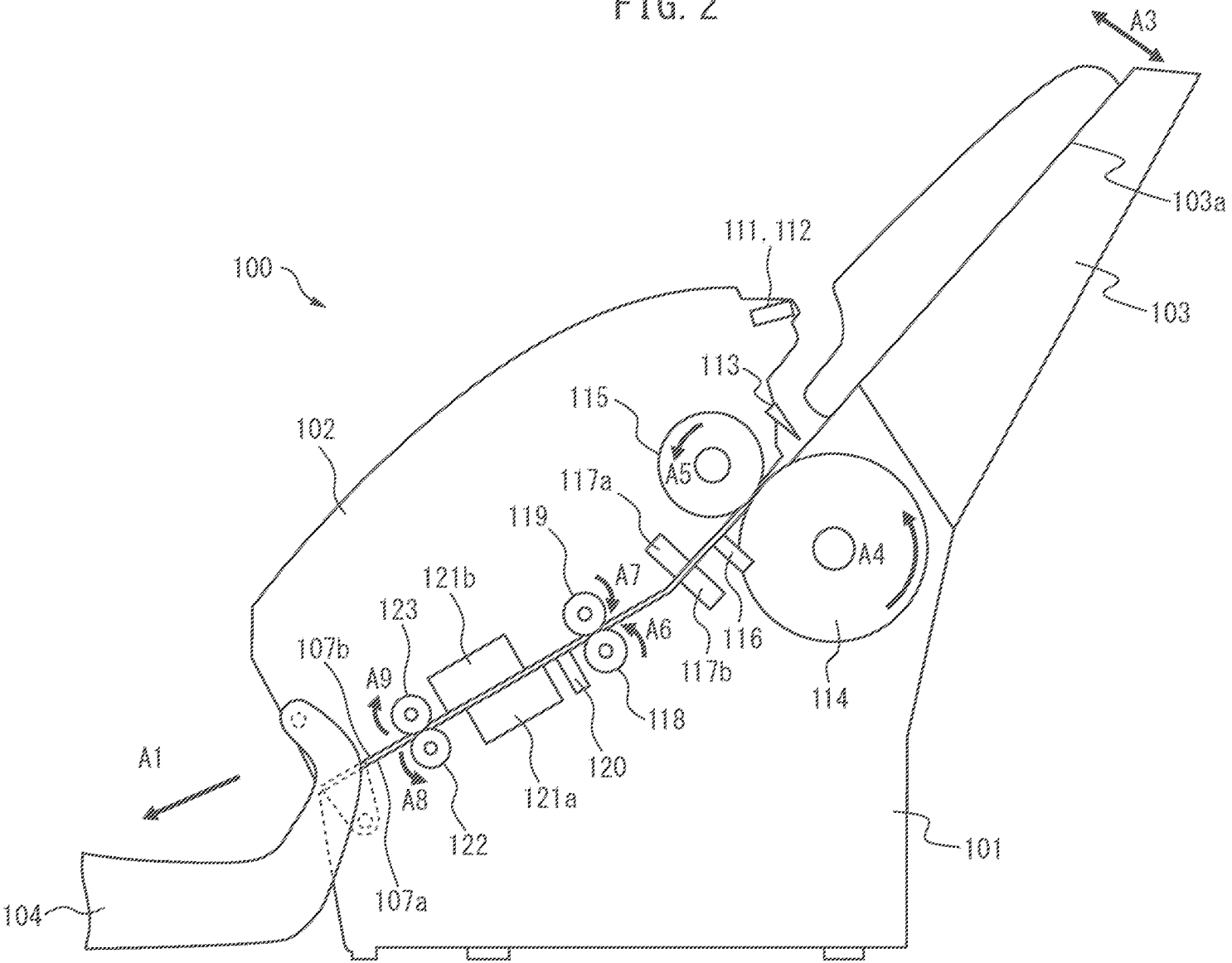
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 include a first sensor 111, a second sensor 112, a third sensor 113, a feed roller 114, a brake roller 115, a fourth sensor 116, an ultrasonic transmitter 117*a*, an ultrasonic receiver 117*b*, a first conveyance roller 118, a second conveyance roller 119, a fifth sensor 120, a first imaging device 121*a*, a second imaging device 121*b*, a third conveyance roller 122, and a fourth conveyance roller 123, etc. The numbers of each roller is not limited to one, and may be plural. Hereinafter, the first imaging device 121*a* and the second imaging device 121*b* may be collectively referred to as an imaging device 121.

A top surface of the lower housing 101 forms a lower guide 107*a* of a conveyance path of a medium, and a bottom surface of the upper housing 102 forms an upper guide 107*b* of the conveyance path of a medium. An arrow A1 in FIG. 2 indicates a medium conveying direction. An upstream hereinafter refers to an upstream in the medium conveying direction A1, and a downstream refers to a downstream in the medium conveying direction A1.

The third sensor 113 is located on a downstream side of the first sensor 111 and the second sensor 112 and on an upstream side of the feed roller 114 and the brake roller 115. The third sensor 113 has a contact detection sensor, and detects whether or not the medium is placed on the medium tray 103. The third sensor 113 generates and outputs a third medium signal whose signal value changes in a state where the medium is placed on the medium tray 103 and a state where the medium is not placed.

The feed roller 114 is provided on the lower housing 101 and sequentially feeds the medium placed on the medium tray 103 from a lower side. The brake roller 115 is provided in the upper housing 102 and are located to face the feed rollers 114.

The fourth sensor 116 is located on a downstream side of the feed roller 114 and the brake roller 115 and on an upstream side of the first conveyance roller 118 and the second conveyance roller 119. The fourth sensor 116 detects whether or not the medium exists at the position. The fourth sensor 116 includes a light emitter and a light receiver provided on one side with respect to the conveyance path of the medium, and a reflection member such as a mirror provided at a position facing the light emitter and the light receiver with the conveyance path in between. The light emitter emits light toward the conveyance path. On the other hand, the light receiver receives light emitted by the light emitter and reflected by the reflection member and outputs a fourth medium signal which is an electric signal based on intensity of the received light. Since the light emitted by the light emitter is shielded by the medium when the medium is present at the position of the fourth sensor 116, the signal value of the fourth medium signal is changed in a state where the medium is present at the position of the fourth sensor 116 and a state where the medium is not present. The light emitter and the light receiver may be provided at positions facing one another with the conveyance path in between, and the reflection member may be omitted.

The ultrasonic transmitter 117*a* and the ultrasonic receiver 117*b* are located on the downstream side of the feed roller 114 and the brake roller 115 and on the upstream side of the first conveyance roller 118 and the second conveyance roller 119 in the medium conveying direction A1. The ultrasonic transmitter 117*a* and the ultrasonic receiver 117*b* are located close to the conveyance path of a medium in such a way as to face one another with the conveyance path in between. The ultrasonic transmitter 117*a* is capable of outputting an ultrasonic wave. On the other hand, the ultrasonic receiver 117*b* receives an ultrasonic wave being transmitted by the ultrasonic transmitter 117*a* and passing through a medium, and generates and outputs an ultrasonic signal being an electric signal corresponding to the received ultrasonic wave. Hereinafter, the ultrasonic transmitter 117*a* and the ultrasonic receiver 117*b* may be collectively referred to as an ultrasonic sensor 117.

The first conveyance roller 118 and the second conveyance roller 119 are located on the downstream side of the feeding roller 114 and the brake roller 115 and on an upstream side of the imaging device 121 in the medium conveying direction A1.

The fifth sensor 120 is located on the downstream side of the first conveyance roller 118 and the second conveyance roller 119 and on the upstream side of the imaging device 121 in the medium conveying direction A1, and at a substantially central portion in the width direction A2 perpendicular to the medium conveying direction. The fifth sensor 120 detects whether or not the medium exists at the position. The fifth sensor 120 includes a light emitter and a light receiver provided on one side with respect to the conveyance path of the medium, and a reflection member such as a mirror provided at a position facing the light emitter and the light receiver with the conveyance path in between. The light emitter emits light toward the conveyance path. On the other hand, the light receiver receives light emitted by the light emitter and reflected by the reflection and outputs a fifth medium signal being an electric signal based on intensity of the received light. Since the light emitted by the light emitter is shielded by the medium when the medium is present at the position of the fifth sensor 120, the signal value of the fifth medium signal is changed in a state where the medium is present at the position of the fifth sensor 120 and a state where the medium is not present. The light emitter and the light receiver may be provided at positions facing one another with the conveyance path in between, and the reflection member may be omitted.

The first imaging device 121*a* is located on the downstream side of the first conveyance roller 118 and the second conveyance roller 119 in the medium conveying direction A1. The first imaging device 121*a* includes a line sensor based on a unity-magnification optical system type contact image sensor (CIS) including an imaging element based on a complementary metal oxide semiconductor (CMOS) linearly located in a main scanning direction. The line sensor is an example of an imaging sensor to image a medium. The first imaging device 121*a* includes a light source to irradiate light toward the conveyed medium, a lens for forming an image on the imaging element, and an A/D converter for amplifying and analog-digital (A/D) converting an electric signal output from the imaging element. The first imaging device 121*a* sequentially generates and outputs line images acquired by imaging an area of a front surface of the conveyed medium facing the line sensor at certain intervals. Specifically, a pixel count of a line image in a vertical direction (subscanning direction) is 1, and a pixel count in a horizontal direction (main scanning direction) is larger than 1.

Similarly, the second imaging device 121*b* is located on the downstream side of the first conveyance roller 118 and the second conveyance roller 119 in the medium conveying direction A1. The second imaging device 121*b* includes a line sensor based on a unity-magnification optical system type CIS including an imaging element based on a CMOS linearly located in a main scanning direction. The line sensor is an example of an imaging sensor to image a medium. Further, the second imaging device 121*b* includes a light source to irradiate light toward the conveyed medium, a lens for forming an image on the imaging element, and an A/D converter for amplifying and analog-digital (A/D) converting an electric signal output from the imaging element. The second imaging device 121*b* sequentially generates and outputs line images acquired by imaging an area of a back surface of the conveyed medium facing the line sensor at certain intervals.

Only either of the first imaging device 121*a* and the second imaging device 121*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

The fifth sensor 120 and the imaging device 121 are an example of a skew sensor, and are used to detect a skew of the medium conveyed by the first conveyance roller 118 and the second conveyance roller 119.

The medium placed on the medium tray 103 is conveyed between the lower guide 107*a* and the upper guide 107*b* in the medium conveying direction A1 by the feeding roller 114 rotating in a direction of an arrow A4 in FIG. 2. The brake roller 115 rotates in a direction of an arrow A5 when the medium is conveyed. By the workings of the feed roller 114 and the brake roller 115, when a plurality of media are placed on the medium tray 103, only a medium in contact with the feed roller 114, out of the media placed on the medium tray 103, is separated. Consequently, the medium conveying apparatus 100 operates in such a way that conveyance of a medium other than the separated medium is restricted (prevention of multi-feed). The feed roller 114 and the brake roller 115 is an example of a first roller to feed by separating the medium placed on the medium tray 103.

The medium is fed between the first conveyance roller 118 and the second conveyance roller 119 while being guided by the lower guide 107*a* and the upper guide 107*b*. The medium is fed between the first imaging device 121*a* and the second imaging device 121*b* by the first conveyance roller 118 and the second conveyance roller 119 rotating in directions of an arrow A6 and arrow A7, respectively. The first conveyance roller 118 and the second conveyance roller 119 are an example of a second roller to convey the medium fed by the feeding roller 114 and the brake roller 115 to the downstream side in the medium conveying direction A1 The medium read by the imaging device 121 is ejected on the ejection tray 104 by the third conveyance rollers 122 and the fourth conveyance rollers 123 rotating in directions of an arrow A8 and an arrow A9, respectively.

Figure 3:
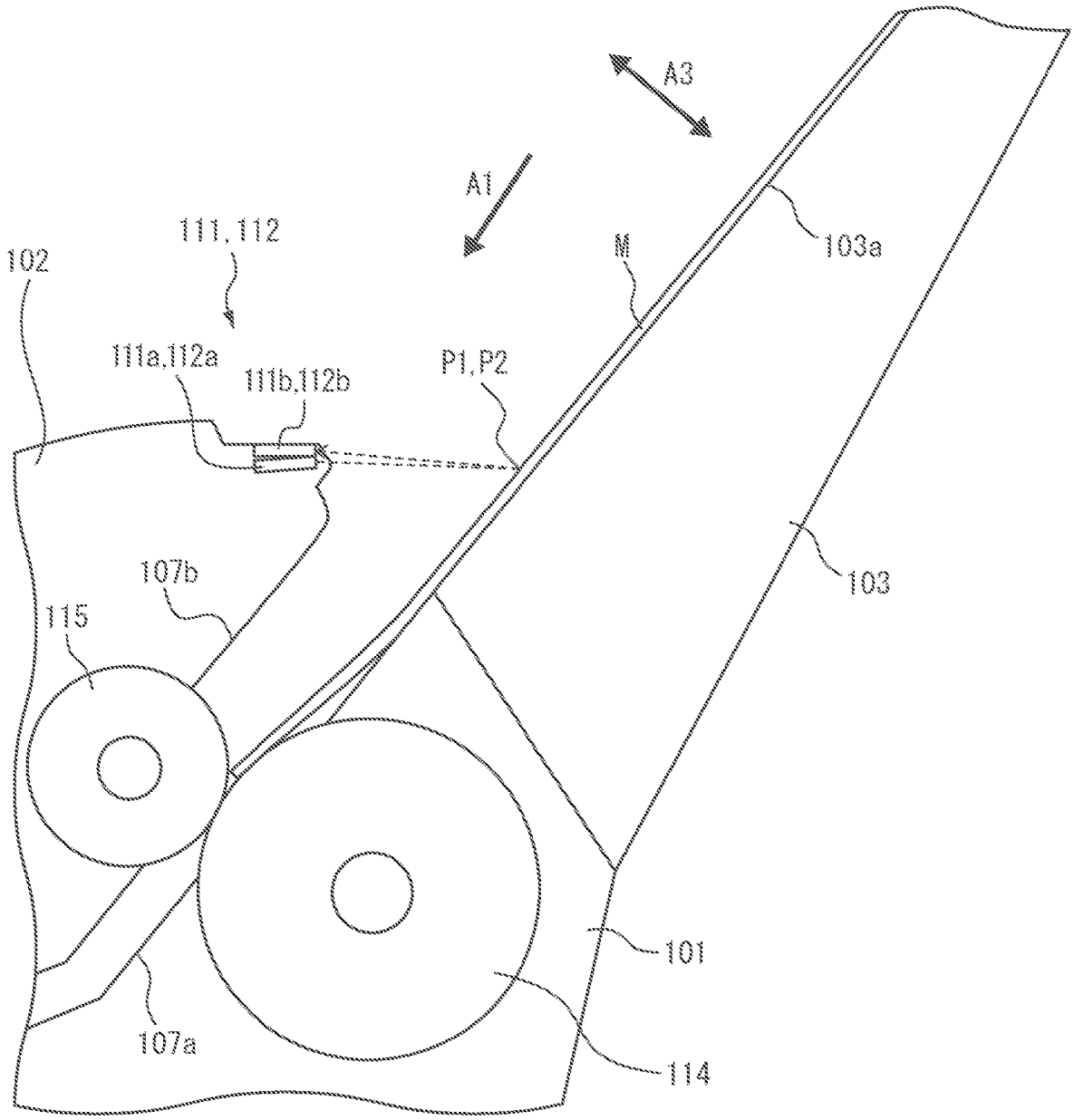
FIG. 3 is a schematic diagram for illustrating an arrangement of the first sensor 111, etc.
Figure 4:
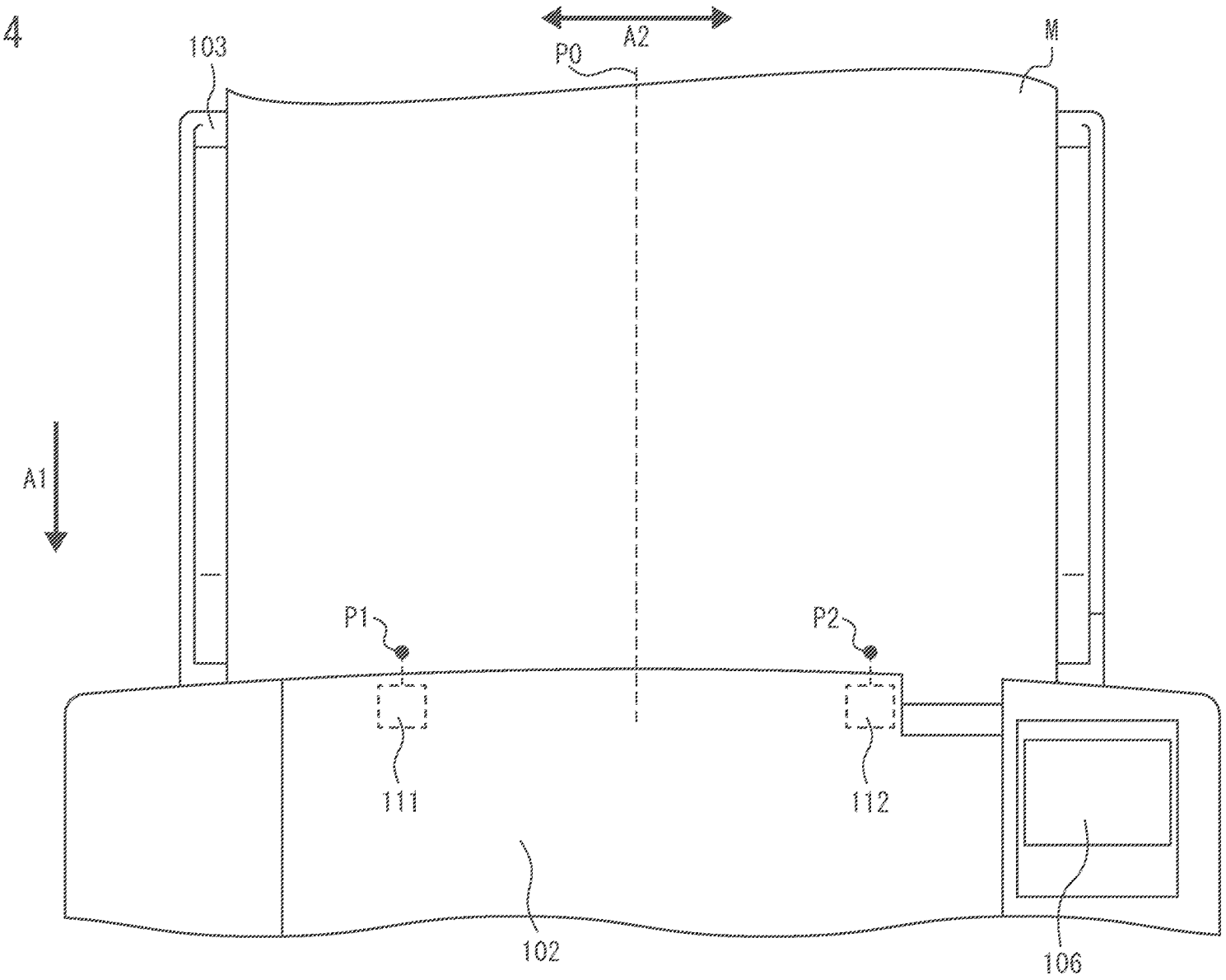
FIG. 4 is a schematic diagram for illustrating an arrangement of the first sensor 111, etc.

FIG. 3 and FIG. 4 are schematic diagrams for illustrating an arrangement of the first sensor 111 and the second sensor 112, etc. FIG. 3 is a schematic view of an upstream side of the medium conveying apparatus 100 viewed from a side. FIG. 4 is a schematic view of an upstream side of the medium conveying apparatus 100 from above.

As shown in FIG. 3, the first sensor 111 and the second sensor 112 are located on the upper guide 107*b*, i.e., on an upper side of the conveyance path of the medium, and on the upstream side of the feed roller 114 and the brake roller 115 in the medium conveying direction A1 As shown in FIG. 4, the first sensor 111 and the second sensor 112 are spaced and located alongside in the width direction A2 The first sensor 111 is located on one side (left side in FIG. 4) of a center position P0 of the medium tray 103, and the second sensor 112 is located on the other side (right side in FIG. 4) of the center position P0 of the medium tray 103.

The first sensor 111 is an infrared access distance sensor and measures a distance from an object existing at a facing position, based on a time difference between emission and reflection of infrared rays. The first sensor 111 includes a first light emitter 111*a* and a first light receiver 111*b*. The first light emitter 111*a* emits light (infrared light) toward the placing surface 103*a* of the medium tray 103 or the medium M placed on the medium tray 103. In particular, the first light emitter 111*a* emits light toward a position on the upstream side in the medium conveying direction A1 and facing the first light emitter 111*a* in the width direction A2. On the other hand, the first light receiver 111*b* receives light emitted by the first light emitter 111*a* and reflected by the placing surface 103*a* of the medium tray 103 or the medium M placed on the medium tray 103, generates a first medium signal which is an electric signal corresponding to the received light, and outputs the first medium signal as an output signal.

The first medium signal indicates a time from when the first light emitter 111*a* emits light to when the first light receiver 111*b* receives light, and a light amount of light received by the first light receiver 111*b*. Therefore, the first medium signal changes in accordance with a distance from the first sensor 111 to the first portion P1 irradiated by the first light emitter 111*a* in the medium M placed on the medium tray 103.

Similarly, second sensor 112 is an infrared access distance sensor and measures a distance from an object existing at a facing position, based on a time difference between emission and reflection of infrared rays. The second sensor 112 includes a second light emitter 112*a* and a second light receiver 112*b* The second light emitter 112*a* emits light (infrared light) toward the placing surface 103*a* of the medium tray 103 or the medium placed on the medium tray 103. In particular, the second light emitter 112*a* emits light toward a position on the upstream side in the medium conveying direction A1 and facing the second light emitter 112*a* in the width direction A2. On the other hand, the second light receiver 112*b* receives light irradiated by the second light emitter 112*a* and reflected by the mounting surface 103*a* of the medium tray 103 or the medium placed on the medium tray 103, and generates a second medium signal which is an electric signal corresponding to the received light, and outputs the second medium signal as an output signal.

The second medium signal indicates a time from when the second light emitter 112*a* emits light to when the second light receiver 112*b* receives light, and a light amount of light received by the second light receiver 112*b*. Therefore, the second medium signal changes in accordance with a distance from the second sensor 112 to the second portion P2 irradiated by the second light emitter 112*a* in the medium M placed on the medium tray 103.

The first sensor 111 and the second sensor 112 are an example of a floating sensor, and are used to detect a floating (deflection) of the medium M placed on the medium tray 103. The medium conveying apparatus 100 can accurately detect the floating of the medium by using the light sensor including the light emitter and the light receiver as the floating sensor. Known infrared proximity distance sensors that can measure distances, for example, with a resolution of 1 mm in the range of 0 to 100 mm, can be utilized as the first sensor 111 and the second sensor 112. The number of sensors to detect the floating of the medium is not limited to two, it may be one or more.

In addition, the medium conveying apparatus 100 may use a contact detection sensor instead of the light sensor including the light emitter and the light receiver as the floating sensor. The contact detection sensor is located on the upper guide 107*b*, i.e., on the upper side of the conveyance path of the medium, and on the upstream side of the feed roller 114 and the brake roller 115. The contact sensing sensor includes an arm contactable to the medium to be fed and movably provided by the medium to be contacted, and generates an electrical signal corresponding to an amount of movement of the arm as the first medium signal or the second medium signal and outputs it as the output signal.

Figure 5:
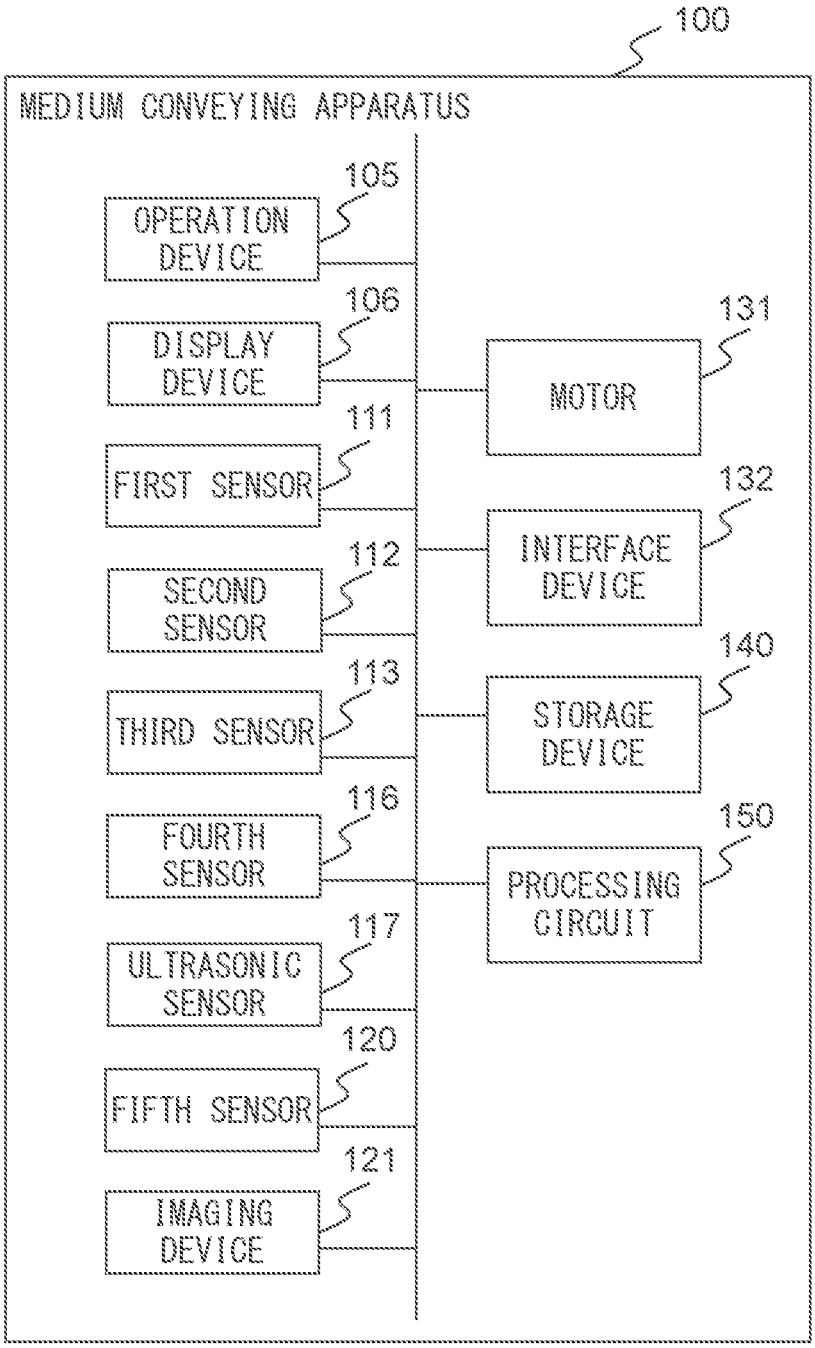
FIG. 5 is a block diagram illustrating a schematic configuration of a medium conveying apparatus 100.

FIG. 5 is a block diagram illustrating a schematic configuration of the medium conveying apparatus 100.

The medium conveying apparatus 100 further includes a motor 131, an interface device 132, a storage device 140, and a processing circuit 150, etc., in addition to the configuration described above.

The motor 131 includes one or more motors to rotate the feed roller 114, the brake roller 115, and the first to fourth conveyance rollers 118, 119, 122, and 123 to convey the medium by a control signal from the processing circuit 150.

For example, the interface device 132 includes an interface circuit conforming to a serial bus such as universal serial bus (USB), is electrically connected to an unillustrated information processing device, and transmits and receives an input image and various types of information. Further, a communication device including an antenna transmitting and receiving wireless signals, and a wireless communication interface device for transmitting and receiving signals through a wireless communication line in conformance with a predetermined communication protocol may be used in place of the interface device 132. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The processing circuit 150 operates in accordance with a program previously stored in the storage device 140. The processing circuit 150 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operation device 105, the display device 106, the first sensor 111, the second sensor 112, the third sensor 113, the fourth sensor 116, the ultrasonic sensor 117, the fifth sensor 120, the imaging device 121, the motor 131, the interface device 132 and the storage device 140, etc., and controls each of these units. The processing circuit 150 performs drive control of the motor 131, imaging control of the imaging device 121, etc., generates an input image, and transmits the input image to the information processing apparatus via the interface device 132. Further, the processing circuit 150 determines whether or not a conveyance abnormality of the medium has occurred, based on the first medium signal from the first sensor 111, the second medium signal from the second sensor 112, the fifth medium signal from the fifth sensor 120, and the line image from the imaging device 121, etc.

Figure 6:
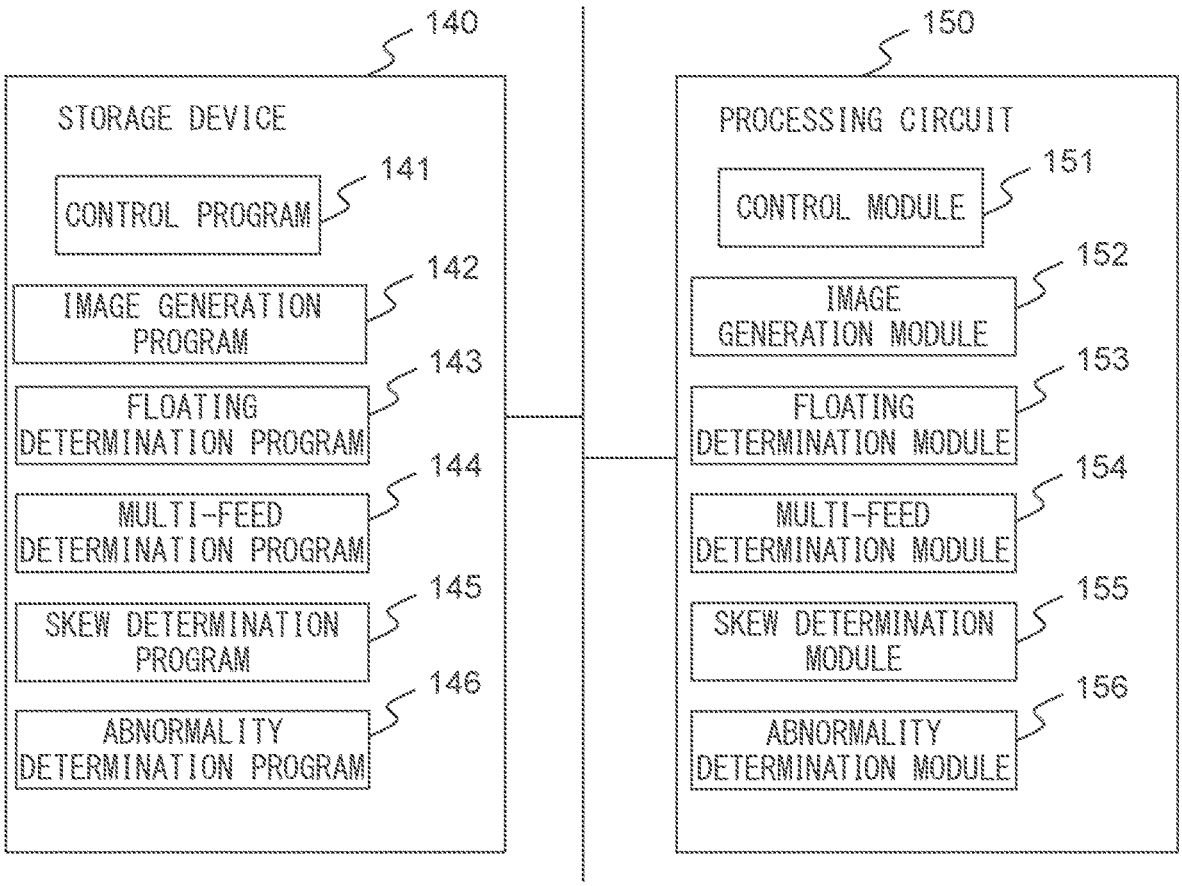
FIG. 6 is a diagram illustrating schematic configurations of a storage device 140 and a processing circuit 150.

FIG. 6 is a diagram illustrating schematic configurations of the storage device 140 and the processing circuit 150.

As shown in FIG. 6, the storage device 140 stores a control program 141, an image generation program 142, a floating determination program 143, a multi-feed determination program 144, a skew determination program 145, and an abnormality determination program 146, etc. Each of these programs is a functional module implemented by software operating on a processor. The processing circuit 150 reads each program stored in the storage device 140 and operates in accordance with each read program. Thus, the processing circuit 150 functions as a control module 151, an image generation module 152, a floating determination module 153, a multi-feed determination module 154, a skew determination module 155, and an abnormality determination module 156.

Figure 7:
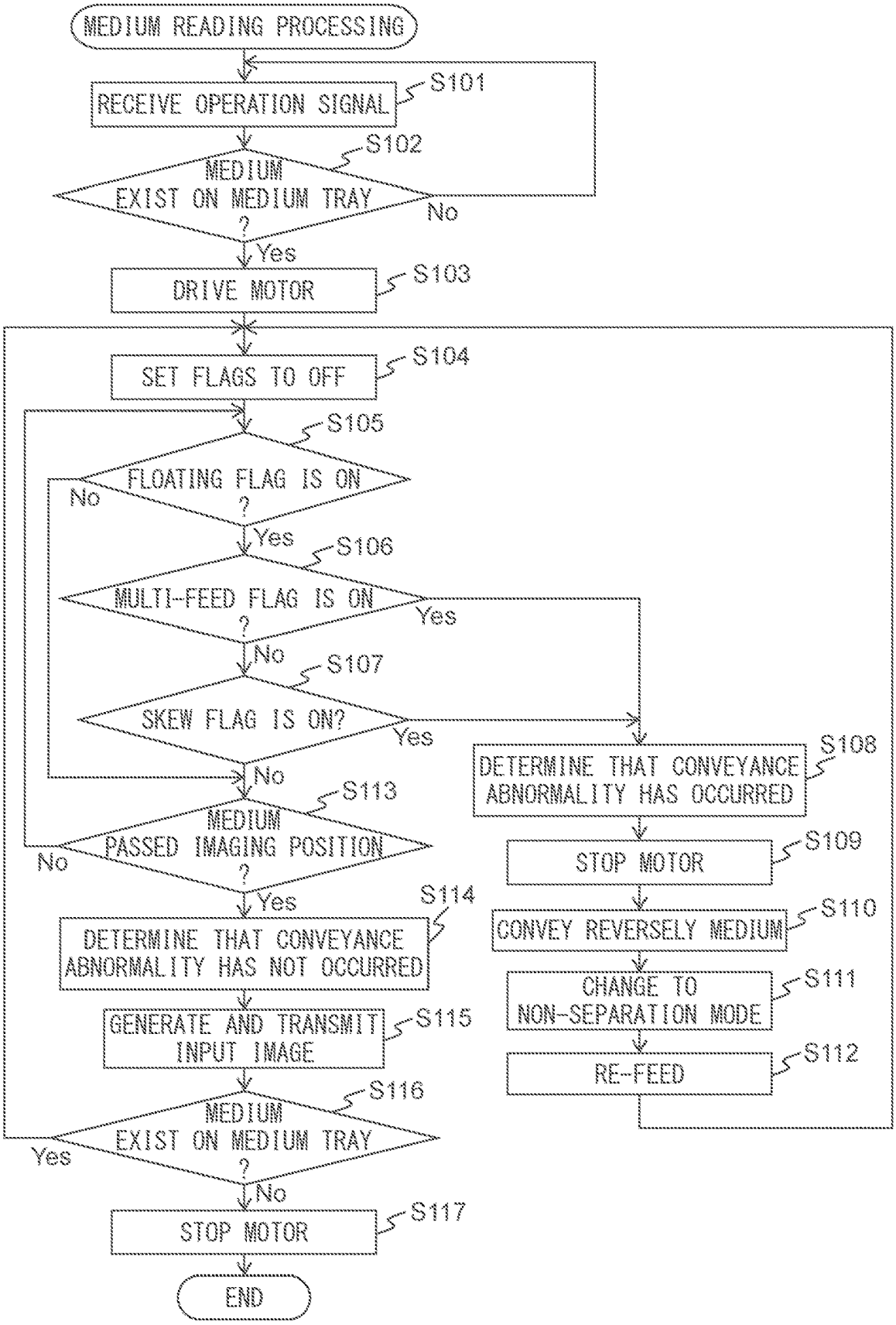
FIG. 7 is a flowchart illustrating an operation example of the medium reading processing.

FIG. 7 is a flowchart illustrating an operation example of a medium reading processing in the medium conveying apparatus 100.

Referring to the flowchart illustrated in FIG. 7, an operation example of the medium reading processing in the medium conveying apparatus 100 will be described below. The operation flow described below is executed mainly by the processing circuit 150 in cooperation with each element in the medium conveying apparatus 100, in accordance with a program previously stored in the storage device 140. The operation flow illustrated in FIG. 7 is periodically executed. The medium conveying apparatus 100 has a separation mode for feeding by separating a plurality of media, and a non-separation mode for feeding without separating the medium, as a feeding mode for feeding the medium. The flow of operation shown in FIG. 7 is performed when the feeding mode is set to the separation mode.

First, the control module 151 stands by until an instruction to read a medium is input by a user by use of the operation device 105, and an operation signal instructing to read the medium is received from the operation device 105 (step S101).

Next, the control module 151 acquires the third medium signal from the third sensor 113, and determines whether or not the medium is placed on the medium tray 103, based on the acquired third medium signal (step S102).

When a medium is not placed on the medium tray 103, the control module 151 returns the processing to step S101 and stands by until newly receiving an operation signal from the operation device 105.

On the other hand, when the medium is placed on the medium tray 103, the control module 151 drives the motor 131 and rotates the feeding roller 114, the brake roller 115, and the first to fourth conveyance rollers 118, 119, 122, and 123 to convey the medium (step S103). In the separation mode, the control module 151 drives the motor 131 so as to rotate the feed roller 114 and the first to fourth feed rollers 118, 119, 122, and 123 in the directions of the arrows A4, A6, A7, A8, and A9 (the medium feeding direction or the medium conveying direction), respectively. Further, the control module 151 drives the motor 131 to rotate the brake roller 115 in the direction of the arrow A5 (the direction opposite to the medium feeding direction).

Next, the control module 151 sets a floating flag, multi-feed flag and skew flag to OFF (step S104). The floating flag is set to ON when the floating determination module 153 determines that the floating of the medium has occurred based on the first medium signal from the first sensor 111 or the second medium signal from the second sensor 112, in a floating determination processing to be described later. The multi-feed flag is set to ON when the multi-feed determination module 154 determines that the multi-feed of the medium has occurred based on the ultrasonic signal from the ultrasonic sensor 117, in a multi-feed determination processing to be described later. The skew flag is set to ON when the skew determination module 155 determines that the skew of the medium has occurred based on the fifth medium signal from the fifth sensor 120 or the line image from the imaging device 121 in the skew determination processing to be described later, Next, the abnormality determination module 156 determines whether or not the floating determination module 153 determines that the floating of the medium has occurred in the floating determination processing (step S105). The abnormality determination module 156 determines whether or not the floating determination module 153 determines that the floating of the medium has occurred depending on whether or not the floating flag is ON. When the floating determination module 153 does not determine that the floating of the medium has occurred, the abnormality determination module 156 proceeds the process to step S113.

On the other hand, when the floating determination module 153 determines that the floating of the medium has occurred, the abnormality determination module 156 determines whether or not the multi-feed determination module 154 determines that the multi-feed of the medium has occurred in the multi-feed determination processing (step S106). The abnormality determination module 156 determines whether or not the multi-feed determination module 154 determines that the multi-feed of the medium has occurred depending on whether or not the multi-feed flag is ON.

When the multi-feed determination module 154 does not determine that the multi-feed of the medium has occurred, the abnormality determination module 156 determines whether or not the skew determination module 155 determines that the skew of the medium has occurred in the skew determination processing (step S107). The abnormality determination module 156 determines whether or not the skew determination module 155 determines that the skew of the medium has occurred depending on whether or not the skew flag is ON.

When the multi-feed determination module 154 determines that the multi-feed of the medium has occurred, or when the skew determination module 155 determines that the skew of the medium has occurred, the abnormality determination module 156 determines that the conveyance abnormality such as a jam (paper jam) of the medium has occurred (step S108). As described above, the abnormality determination module 156 determines that the conveyance abnormality of the medium has occurred when the floating determination module 153 determines that the floating of the medium has occurred, and the skew determination module 155 determines that the skew of the medium has occurred. Further, the abnormality determination module 156 determines that the conveyance abnormality of the medium has occurred when the floating determination module 153 determines that the floating of the medium has occurred, and the multi-feed determination module 154 determines that the multi-feed of the medium has occurred.

Next, when the abnormality determination module 156 determines that the conveyance abnormality of the medium has occurred, the control module 151 stops the motor 131 to stop feeding and conveying the medium (step S109). The control module 151 can suppress the medium from being damaged by stopping feeding and conveying the medium when the conveyance abnormality such as the jam of the medium has occurred. Further, the control module 151 notifies the user of a warning by displaying information indicating that an abnormality has occurred on the display device 106 or transmitting the information to the information processing device via the interface device 132.

Next, the controller 151 drives the motor 131 to rotate the feeding roller 114 and the first to fourth conveyance rollers 118, 119, 122, and 123 in directions opposite to the arrows A4, A6, A7, A8, and A9 (the medium feeding direction or the medium conveying direction), respectively. Further, the control module 151 drives the motor 131 to rotate the brake roller 115 in the direction of the arrow A5 (the direction opposite to the medium feeding direction). Thus, the control module 151 conveys reversely the medium, and once returns the medium to the medium tray 103 (step S110).

Next, the control module 151 changes the feeding mode from the separation mode to the non-separation mode (step S111). In the non-separation mode, the control module 151 rotates the feeding roller 114 and the first to fourth conveyance rollers 118, 119, 122, and 123 in the directions of the arrows A4, A6, A7, A8, and A9 (the medium feeding direction or the medium conveying direction), respectively. Further, in the non-separation mode, the control module 151 shuts off the driving force from the motor 131 to the brake roller 115 to turn off the separation function of the medium to be fed. The control module 151 may turn off the separation function of the medium to be fed by rotating the brake roller 115 in the medium feeding direction (the direction opposite to the arrow A5) or by reducing the separation force by the brake roller 115.

Next, the control module 151 re-drives the motor 131 and re-rotates the feeding roller 114 and the first to fourth conveyance rollers 118, 119, 122, and 123 in the medium feeding direction or the medium conveying direction to re-feed and re-convey the medium (step S112). Next, the control module 151 proceeds the process to step S104. At this time, the brake roller 115 is driven by the feed roller 114 or rotates in the medium feeding direction by the motor 131 so as not to separate the medium.

Thus, the control module 151 once returns the medium to the medium tray 103, and controls the feed roller 114 and the brake roller 115 to re-feed without separating when the control module 151 stops feeding the medium. Consequently, a user does not need to re-feed the media by turning off the separation function of the medium, and the control module 151 can improve the convenience of the user. Incidentally, the processes of steps S110 and S112 are omitted, the control module 151 may only execute changing the feed mode while stopping feeding and conveying the medium. In that case, the user does not need to change the feeding mode, the control module 151 can improve the convenience of the user.

On the other hand, when the skew determination module 155 does not determine that the skew of the medium has occurred in step S107, the control module 151 determines whether or not the entire medium has passed through an imaging position of the imaging device 121 (step S113). The control module 151 periodically acquires the fifth medium signal from the fifth sensor 120 and determines whether or not the medium is present at the position of the fifth sensor 120 based on the acquired fifth medium signal. The control module 151 determines that the rear end of the medium has passed through the position of the fifth sensor 120 when the signal value of the fifth medium signal changes from the value indicating existence of a medium to the value indicating nonexistence of a medium. The control module 151 determines that the entire medium has passed thorough the imaging position when a predetermined time has elapsed after the rear end of the medium has passed through the position of the fifth sensor 120. Incidentally, the control module 151 may determine that the entire medium has passed through the imaging position when the control module 151 acquires a predetermined number of line images from the imaging device 121. When the entire medium has not yet passed through the imaging position, the control module 151 returns the process to step S105.

On the other hand, when the entire medium has passed through the imaging position, the abnormality determination module 156 determines that the conveyance abnormality of the medium has not occurred (step S114). In other words, the abnormality determination module 156 determines that the conveyance abnormality of the medium has not occurred when the floating determination module 153 does not determine that the floating of the medium has occurred. Further, the abnormality determination module 156 determines that a conveyance abnormality of the medium has not occurred when the multi-feed determination module 154 does not determine that the multi-feed of the medium has occurred and the skew determination module 155 does not determine that the skew of the medium has occurred.

When the floating determination module 153 does not determine that the floating of the medium has occurred, the multi-feed determination module 154 determines that the multi-feed of the medium has occurred and the skew determination module 155 determines that the skew of the medium has occurred, the abnormality determination module 156 determines that an envelope or a slip bound in a brochure shape, etc., has been conveyed in an inclined manner. Further, when the floating determination module 153 does not determine that the floating of the medium has occurred, the multi-feed determination module 154 determines that the multi-feed of the medium has occurred and the skew determination module 155 does not determine that the skew of the medium has occurred, the abnormality determination module 156 determines that an envelope or a slip bound in a brochure shape, etc., has been conveyed without tilting. Further, when the floating determination module 153 does not determine that the floating of the medium has occurred, the multi-feed determination module 154 does not determine that the multi-feed of the medium has occurred and the skew determination module 155 determines that the skew of the medium has occurred, the abnormality determination module 156 determines that the medium has been conveyed in an inclined manner or that the non-rectangular shaped medium has been conveyed. Further, when the floating determination module 153 does not determine that the floating of the medium has occurred, the multi-feed determination module 154 does not determine that the multi-feed of the medium has occurred and the skew determination module 155 does not determine that the skew of the medium has occurred, the abnormality determination module 156 determines that the medium has been conveyed normally.

When the multi-feed and skew of the medium have not occurred, even when the floating of the medium has occurred, the abnormality determination module 156 determines that the conveyance abnormality of the medium has not occurred, and continues feeding and conveying the medium. Further, when the floating of the medium has not occurred, even when the skew or the multi-feed of the medium has occurred, the abnormality determination module 156 determines that the conveyance abnormality of the medium has not occurred, and continues feeding and conveying the medium. The abnormality determination module 156 can reduce the total time required for the medium reading processing, by continuing feeding and conveying the medium when it is unlikely that damage to the medium will occur. The abnormality determination module 156 may notify the user of a warning by displaying the determination result of the floating, multi-feed, and/or skew of the medium to the display device 106 or transmitting it to the information processing device via the interface device 133.

Next, the image generation module 152 acquires each line image generated during conveying the medium from the imaging device 121, synthesizes all the acquired line images to generate the input image, and transmits it to the information processing apparatus via the interface device 132 (step S115).

Next, the control module 151 determines whether or not the medium remains on the medium tray 103 based on the third medium signal acquired from the third sensor 113 (step S116). When a medium remains on the medium tray 103, the control module 151 returns the process to step S104 and repeats the processes in steps S104 to SI 16.

On the other hand, when a medium does not remain on the medium tray 103, the control module 151 stops the motor 131 to stop conveying the medium (step S117), and ends the series of steps.

The process of step S106 is omitted, and the abnormality determination module 156 may determine whether or not the conveyance abnormality of the medium has occurred without determining whether or not the multi-feed of the medium has occurred. Further, the process of step S107 is omitted, and the abnormality determination module 156 may determine whether or not the conveyance abnormality of the medium has occurred without determining whether or not the skew of the medium has occurred. Further, the process of step S109 is omitted, and the control module 151 may only notify the user of the warning without stopping feeding and conveying the medium when the conveyance abnormality of the medium has occurred. Further, the processes of steps S110 to S112 are omitted, the control module 151 may end the series of steps without re-feeding the medium when the control module 151 stops feeding and conveying the medium.

Figure 8:
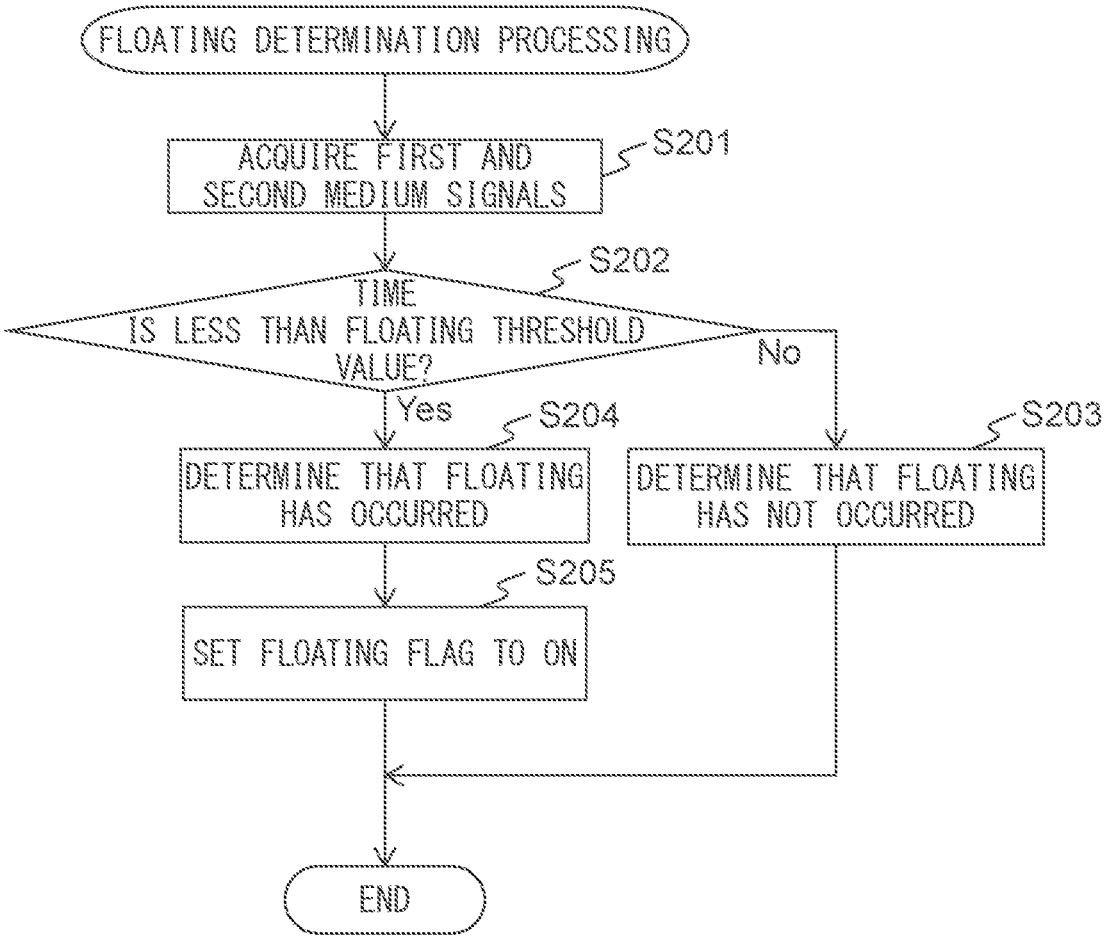
FIG. 8 is a flowchart illustrating an operation example of the floating determination processing.

FIG. 8 is a flowchart illustrating an operation example of the floating determination processing of the medium conveying apparatus 100.

Hereinafter, an example of the operation of the floating determination processing of the medium conveying apparatus 100 will be described with referring to the flowchart illustrated in FIG. 8. The operation flow described below is executed mainly by the processing circuit 150 in cooperation with each element in the medium conveying apparatus 100, in accordance with a program previously stored in the storage device 140. The flow of the operation illustrated in FIG. 8 is periodically executed during medium conveyance.

First, the floating determination module 153 acquires the first medium signal from the first sensor 111 and acquires the second medium signal from the second sensor 112 (step S201). Next, the floating determination module 153 determines whether or not the time indicated in the first medium signal or the time indicated in the second medium signal is less than a floating threshold value (step S202).

Figure 9A:
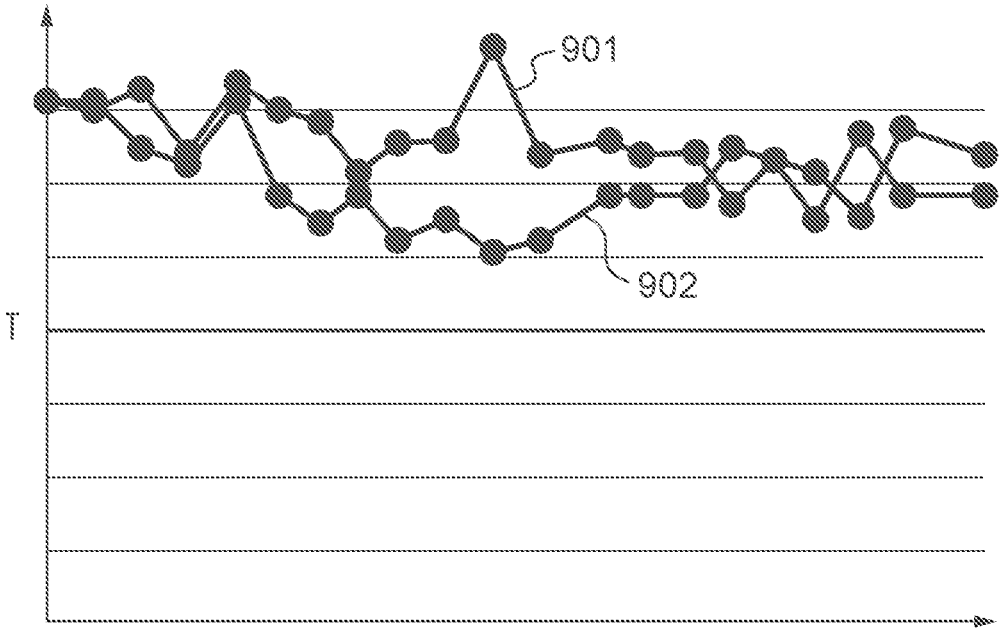
FIG. 9A is a schematic diagram for explaining an example of property of a first medium signal, etc.
Figure 9B:
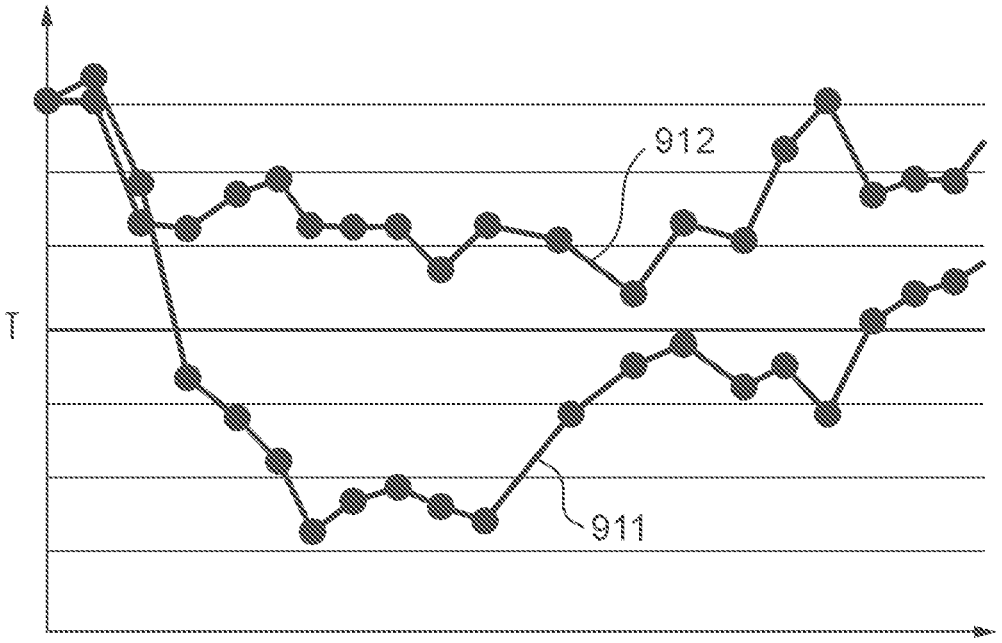
FIG. 9B is a schematic diagram for explaining an example of property of a first medium signal, etc.

FIG. 9A and FIG. 9B are schematic diagrams for illustrating an example of property of the first medium signal and the second medium signal.

FIG. 9A shows the first medium signal 901 and the second medium signal 902 when a medium in which the first part P1 side and the second part P2 side are not bent is conveyed. FIG. 9B shows the first medium signal 911 and the second medium signal 912 when a medium in which the first part P1 side is bent and the second part P2 side is not bent is conveyed. In FIGS. 9A and 9B, the horizontal axis indicates a time from start of conveyance (driving amount of the motor 131), the vertical axis indicates the time indicated in the respective medium signals. When the first medium signal 901 and the second medium signal 902 are generated, the time indicated in the first medium signal 901 and the second medium signal 902 is sufficiently large since the floating of the medium has not occurred at a position irradiated by the first sensor 111 and the second sensor 112. Further, when the second medium signal 912 is generated, the time indicated in the second medium signal 912 is also sufficiently large since the floating of the medium has not occurred at a position irradiated by the second sensor 112. On the other hand, when the first medium signal 911 is generated, the time indicated in the first medium signal 911 is reduced, since the floating of the medium has occurred at a position irradiated by the first sensor 111.

The floating threshold value T is set to a value between the time indicated in the first medium signal and the second medium signal when the floating of the medium has occurred and the time indicated in the first medium signal and the second medium signal when the floating of the medium has not occurred. The floating determination module 153 can determine whether or not the floating of the medium has occurred at a portion corresponding to each medium signal by determining whether or not the time indicated in each medium signal is less than the floating threshold value T.

When the time indicated in the first medium signal and the time indicated in the second medium signal are equal to or more than the floating threshold value, the floating determination module 153 determines that the floating of the medium has not occurred (step S203), and ends the series of steps. On the other hand, when the time indicated in the first medium signal or the time indicated in the second medium signal is less than the floating threshold, the floating determination module 153 determines that the floating of the medium has occurred (step S204). Next, the floating determination module 153 sets the floating flag to ON (step S205), and ends the series of steps.

Thus, the floating determination module 153 determines whether or not the floating of the medium has occurred, based on the output signal from the first sensor 111 and the second sensor 112.

The floating determination module 153 may determine whether or not the floating of the medium has occurred depending on whether or not the change amount of the time indicated in each medium signal is equal to or more than a change threshold value, instead of depending on whether or not the time indicated in each medium signal is less than the floating threshold. Further, the floating determination module 153 may determine whether or not the floating of the medium has occurred depending on whether or not a difference between the time indicated in each medium signal immediately before conveyance and the time indicated in each medium signal during conveyance is equal to or more than the change threshold value. The change threshold value is set to a time corresponding to a change (for example, 1 mm), in the height direction A3 that occurs when the medium is bent. Thus, the floating determination module 153 can accurately determine whether or not the floating of the medium has occurred.

Further, the floating determination module 153 determines whether or not the floating of the medium has occurred depending on whether or not a movement amount indicated in each medium signal is equal to or more than a threshold value when the contact sensor is used instead of the first sensor 111 and the second sensor 112 as the floating sensor.

Figure 10:
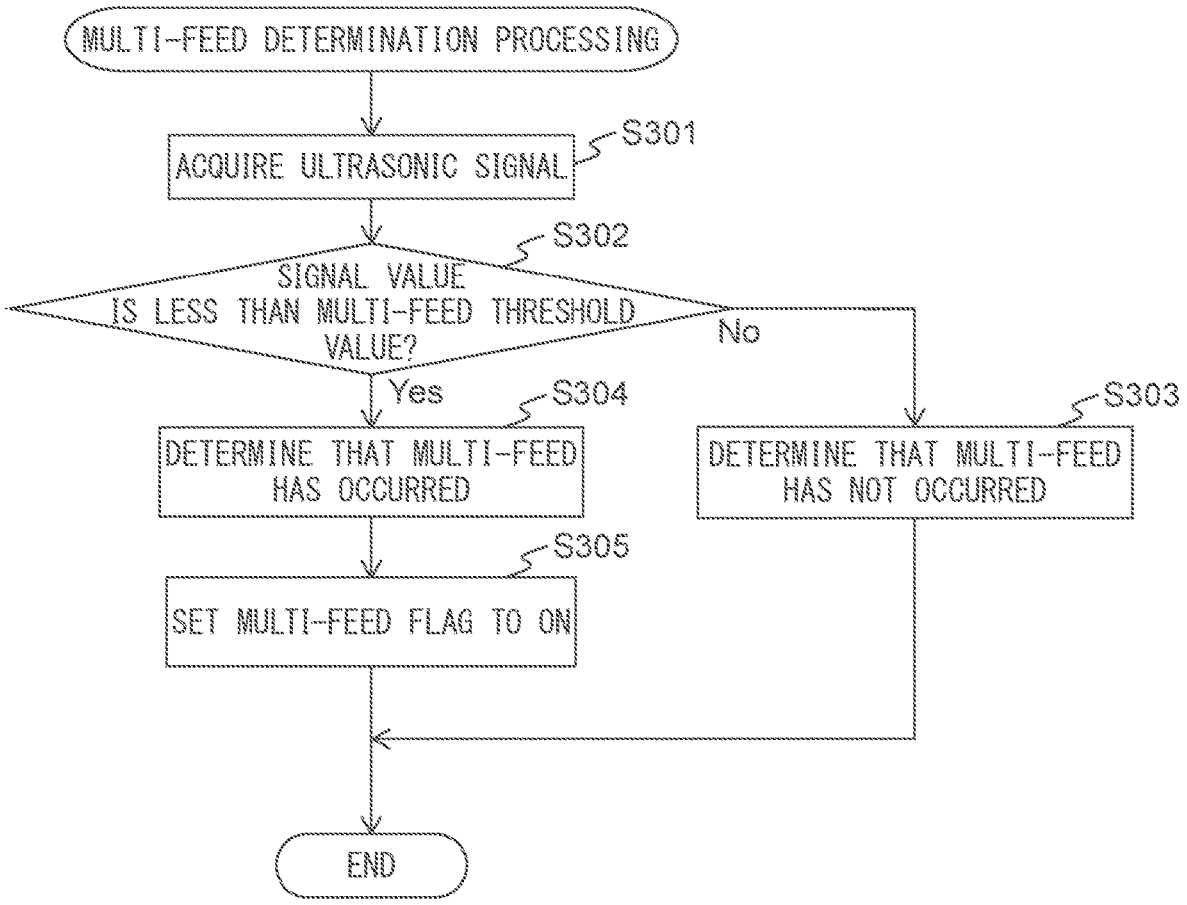
FIG. 10 is a flowchart illustrating an operation example of the multi-feed determination processing.

FIG. 10 is a flowchart illustrating an operation example of the multi-feed determination processing of the medium conveying apparatus 100.

Referring to the flowchart illustrated in FIG. 10, an operation example of the multi-feed determination processing in the medium conveying apparatus 100 will be described below. The operation flow described below is executed mainly by the processing circuit 150 in cooperation with each element in the medium conveying apparatus 100, in accordance with a program previously stored in the storage device 140. The flow of the operation illustrated in FIG. 10 is periodically executed during medium conveyance.

First, the multi-feed determination module 154 acquires the ultrasonic signal from the ultrasonic sensor 117 (step S301). Next, the multi-feed determination module 154 determines whether or not the signal value of the acquired ultrasonic signal is less than the multi-feed threshold value (step S302). The multi-feed threshold value is set to a value between a signal value of an ultrasonic signal when a sheet of paper is conveyed and a signal value of an ultrasonic signal when a multi-feed of paper has occurred.

When the signal value of the ultrasonic signal is equal to or more than the multi-feed threshold value, the multi-feed determination module 154 determines that the multi-feed of the medium has not occurred (step S303), and ends the series of steps. On the other hand, when the signal value of the ultrasonic signal is less than the multi-feed threshold value, the multi-feed determination module 154 determines that the multi-feed of the medium has occurred (step S304). Next, the multi-feed determination module 154 sets the multi-feed flag to ON (step S305), and ends the series of steps.

Thus, the multi-feed determination module 154 determines whether or not the multi-feed of the medium has occurred based on the ultrasonic signal.

Figure 11:
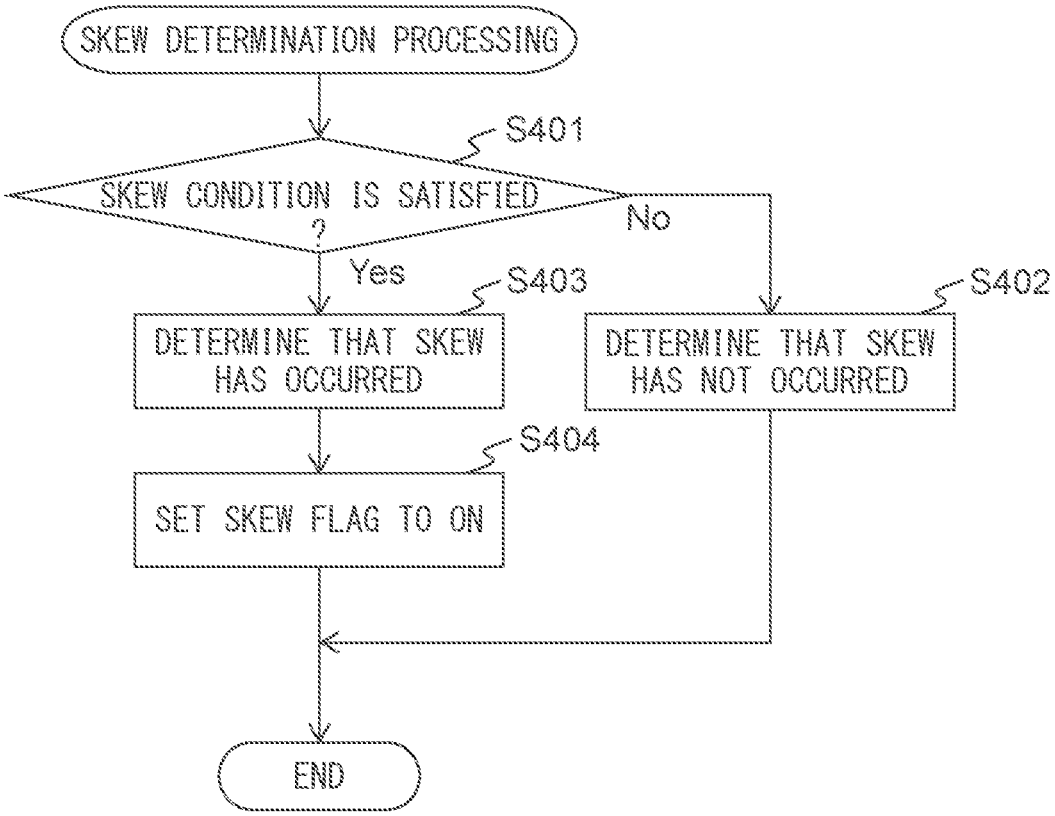
FIG. 11 is a flowchart illustrating an operation example of a skew determination processing.

FIG. 11 is a flowchart illustrating an operation example of the skew determination processing of the medium conveying apparatus 100.

Referring to the flowchart illustrated in FIG. 11, an operation example of the multi-feed determination processing in the medium conveying apparatus 100 will be described below. The operation flow described below is executed mainly by the processing circuit 150 in cooperation with each element in the medium conveying apparatus 100, in accordance with a program previously stored in the storage device 140. The flow of the operation illustrated in FIG. 11 is periodically executed during medium conveyance.

First, the skew determination module 155 determines whether or not a skew condition is satisfied (step S401). The skew determination module 155 determines whether or not a central portion of a from edge of the medium has reached the position of the fifth sensor 120. The skew determination module 155 acquires the fifth medium signal periodically from the fifth sensor 120, and determines whether or not the medium is present at the position of the fifth sensor 120, based on the acquired fifth medium signal. When a signal value of the fifth medium signal changes from a value indicating nonexistence of a medium to a value indicating existence of a medium, the skew determination module 155 determines that the central portion of the front edge of the medium has reached the position of the fifth sensor 120.

Further, the skew determination module 155 determines whether each end of the front edge of the medium has reached the imaging position of the imaging device 121. The skew determination module 155, each time the imaging device 121 generates the line image, acquires the line image from the imaging device 121. The skew determination module 155 calculates an average value of gradation values of pixels in each end region in a predetermined range from both ends of the line image for each of the latest line image and the line image acquired immediately before. The skew determination module 155 determines that each end of the front edge of the medium has reached the imaging position when the absolute value of the difference between the average value calculated from each end region of the latest line image and the average value calculated from each end region of the line image acquired immediately before is equal to or more than a gradation threshold value. On the other hand, the skew determination module 155 determines that each end portion of the front edge of the medium has not yet reached the imaging position when the absolute value of the difference is less than the gradation threshold value. The gradation value is a luminance value or a color value (R value, G value or B value). The gradation threshold value is set to, for example, the difference (e.g., 20) of the gradation values that a person can visually determine the difference in luminance or color on the image.

The skew determination module 155 determines that the skew condition is satisfied when either end of the front edge of the medium reaches the imaging position before the central portion of the front edge of the medium reaches the position of the fifth sensor 120. The skew determination module 155 may determine that the skew condition is satisfied when the central portion of the front edge of the medium has not reached the position of the fifth sensor 120 at a time when a predetermined time has elapsed since either end of the front edge of the medium reaches the imaging position. Further, the skew determination module 155 may determine that the skew condition is satisfied when any end of the front edge of the medium has reached the imaging position before a predetermined time has elapsed since the central portion of the front edge of the medium reaches the position of the fifth sensor 120. On the other hand, in other cases, the skew determination module 155 determines that the skew condition is not satisfied.

The skew determination module 155 may determine whether or not the skew condition is satisfied depending on whether or not a difference in the time at which each of the plurality of portions of the front edge of the medium has reached the imaging position is equal to or more than a threshold value. Further, a plurality of optical sensors may be spaced and located alongside in the width direction A2 in the medium conveying apparatus 100, and the skew determination module 155 may determine whether or not the skew condition is satisfied depending on whether or not the difference in time at which the front edge of the medium reaches the position of each optical sensor is equal to or more than a threshold value.

When the skew condition is not satisfied, the skew determination module 155 determines that the skew of the medium has not occurred (step S402), and ends the series of steps. On the other hand, when the skew condition is satisfied, the skew determination module 155 determines that the skew of the medium has occurred (step S403). Next, the skew determination module 155 sets the skew flag to ON (step S404), and ends the series of steps.

Thus, the skew determination module 155 determines whether or not the skew of the medium has occurred based on the output signal from the imaging device 121 and/or the fifth sensor 120.

Hereinafter, the technical meaning of determining whether or not the conveyance abnormality of the medium has occurred by further determining whether or not the skew and/or the multi-feed of the medium has occurred when the floating of the medium has occurred, will be described.

Figure 12A:
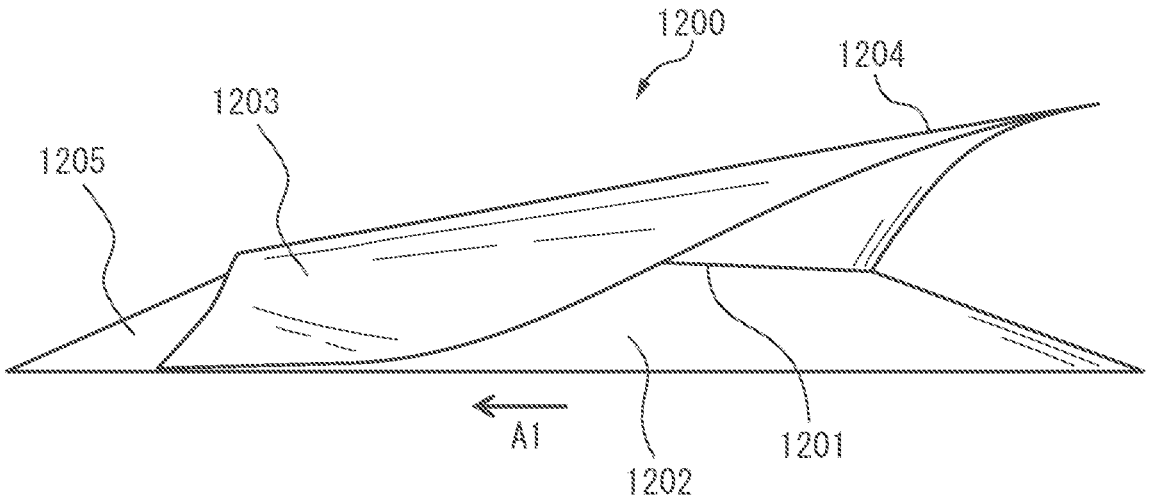
FIG. 12A is a schematic diagram illustrating a state when a medium folded in two is fed.
Figure 12B:
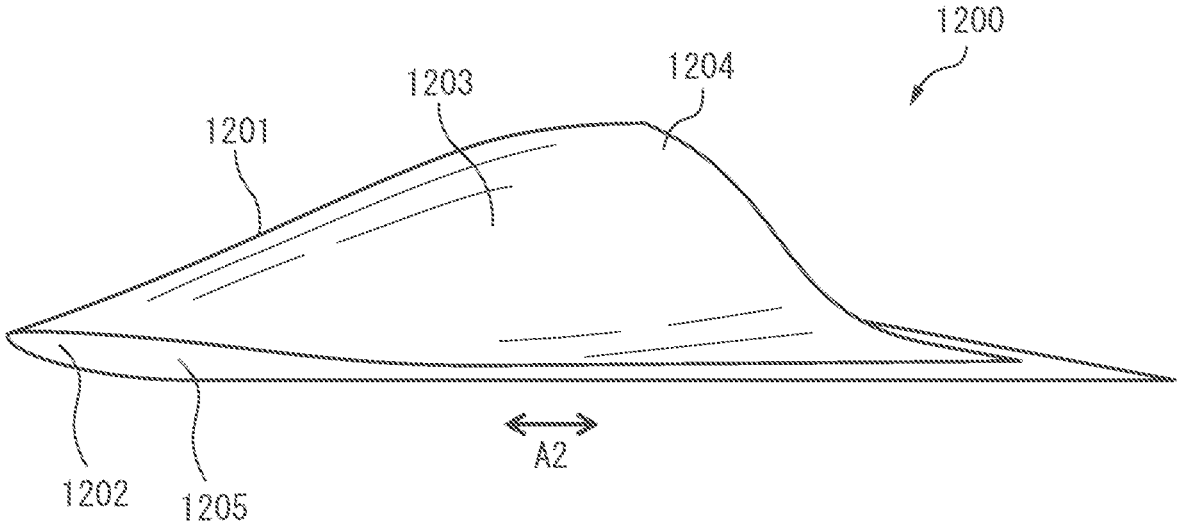
FIG. 12B is a schematic diagram illustrating a state when a medium folded in two is fed.
Figure 12C:
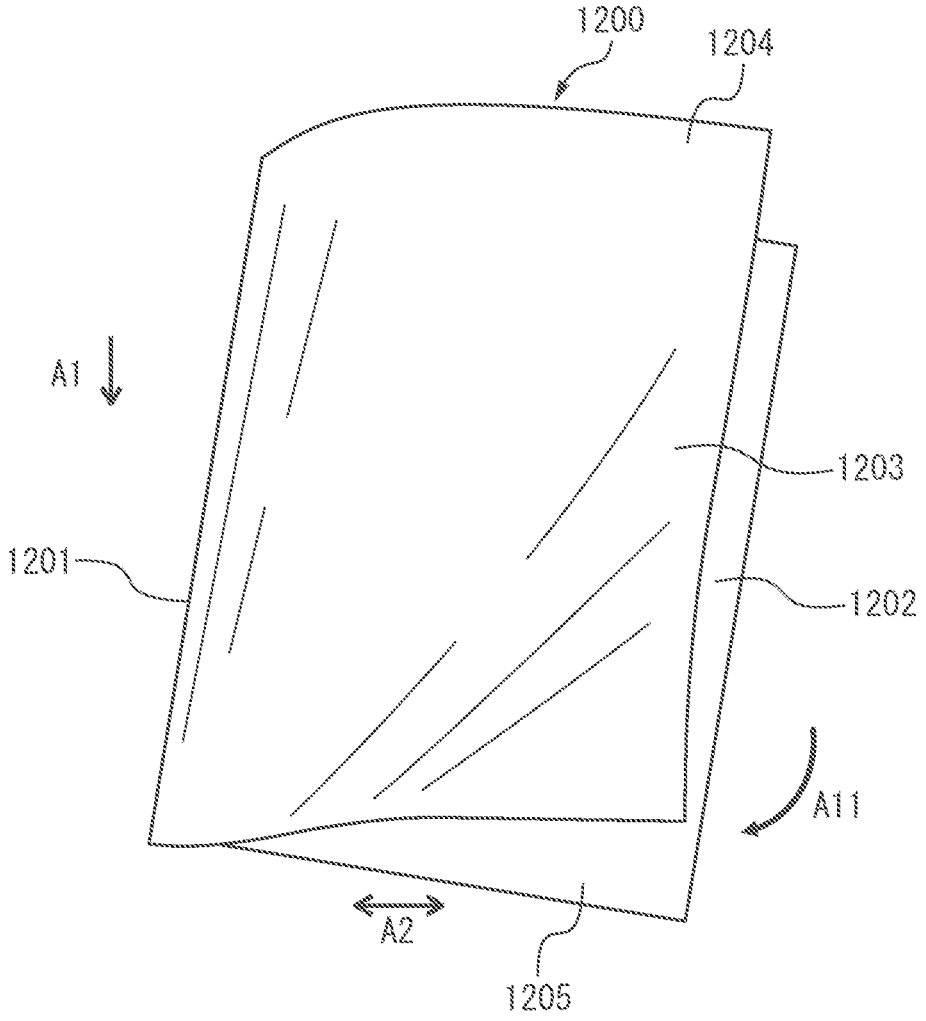
FIG. 12C is a schematic diagram illustrating a state when a medium folded in two is fed.

FIGS. 12A to 12C are schematic diagrams illustrating a state in which a medium 1200 folded in two along the medium conveying direction A1 is fed. FIG. 12A is a schematic diagram of the medium 1200 viewed from the side of the medium conveying apparatus 100. FIG. 1213 is a schematic diagram of the medium 1200 viewed from the downstream side in the medium conveying apparatus 100. FIG. 12C is a schematic diagram of the medium 1200 viewed from above. As shown in FIGS. 12A to 12C, in the medium 1200, one end 1201 along the medium conveying direction A1 is bound. Since the feed roller 114 of the medium conveying apparatus 100 feeds sequentially the media placed on the medium tray 103 from the lower side, a lower portion 1202 of the medium 1200 is conveyed to the downstream side of the feed roller 114, a downstream end of a upper portion 1203 stays on the upstream side of the feed roller 114.

In this case, although the upper portion 1203 attempts to remain by the brake roller 114, a force toward the downstream side is applied to the bound one end 1201 by the lower portion 1202, and thereby an upstream portion 1204 of the upper portion 1203 is bent upward. On the other hand, although the downstream portion 1205 of the lower portion 1202 is fed to the downstream side of the feed roller 113, the lower portion 1202 is conveyed in an inclined manner since the bound one end 1201 attempts to remain at the upstream side by the upper portion 1203. Thus, when the medium folded in two is conveyed, both the floating and the skew of the medium occurs.

Incidentally, for example, as when a large amount of media are loaded on the medium tray 103, when a frictional force between the upper portion 1203 and the lower portion 1202 is sufficiently large, the upper portion 1203 together with the lower portion 1202 may also be conveyed to the downstream side of the feed roller 113. In that case, since the bound one end 1201 is also conveyed to the downstream side, the inclination of the lower portion 1202 is small. Thus, when the medium folded in two is conveyed, the floating and the multi-feed of the medium may occur. Further, when the medium 1200 reaches the feed roller 113, the upper portion 1203 may be inclined, and the inclination of the lower portion 1202 may be small. In that case, the skew of the medium is not detected, the multi-feed of the medium is detected, by the upper portion 1203 and the lower portion 1202 conveyed to the downstream side of the feed roller 113 while slightly inclined.

Figure 13A:
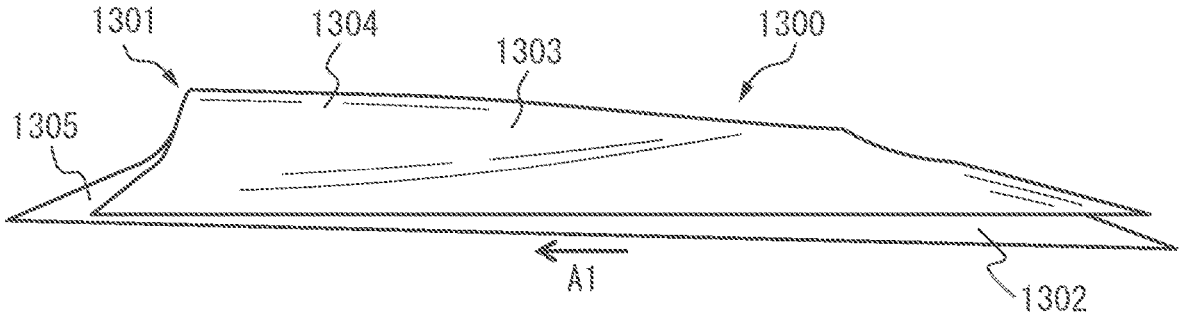
FIG. 13A is a schematic diagram illustrating a state when bound media are fed.
Figure 13B:
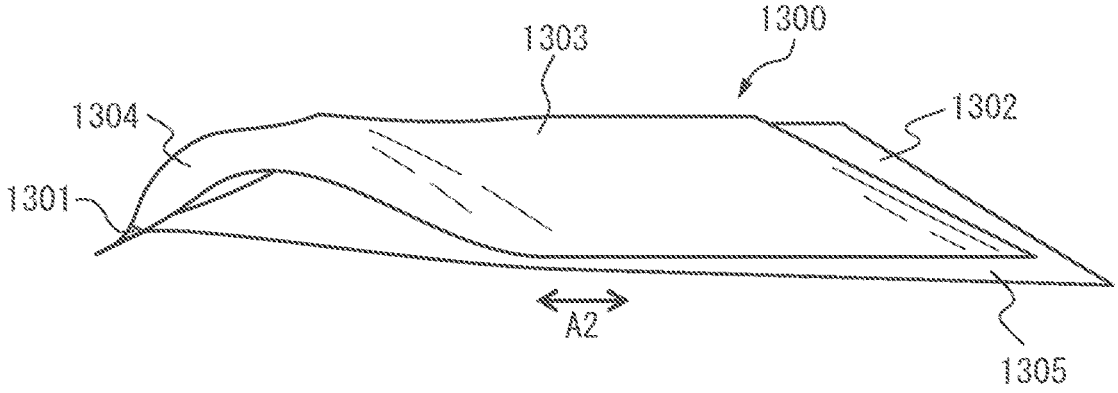
FIG. 13B is a schematic diagram illustrating a state when bound media are fed.
Figure 13C:
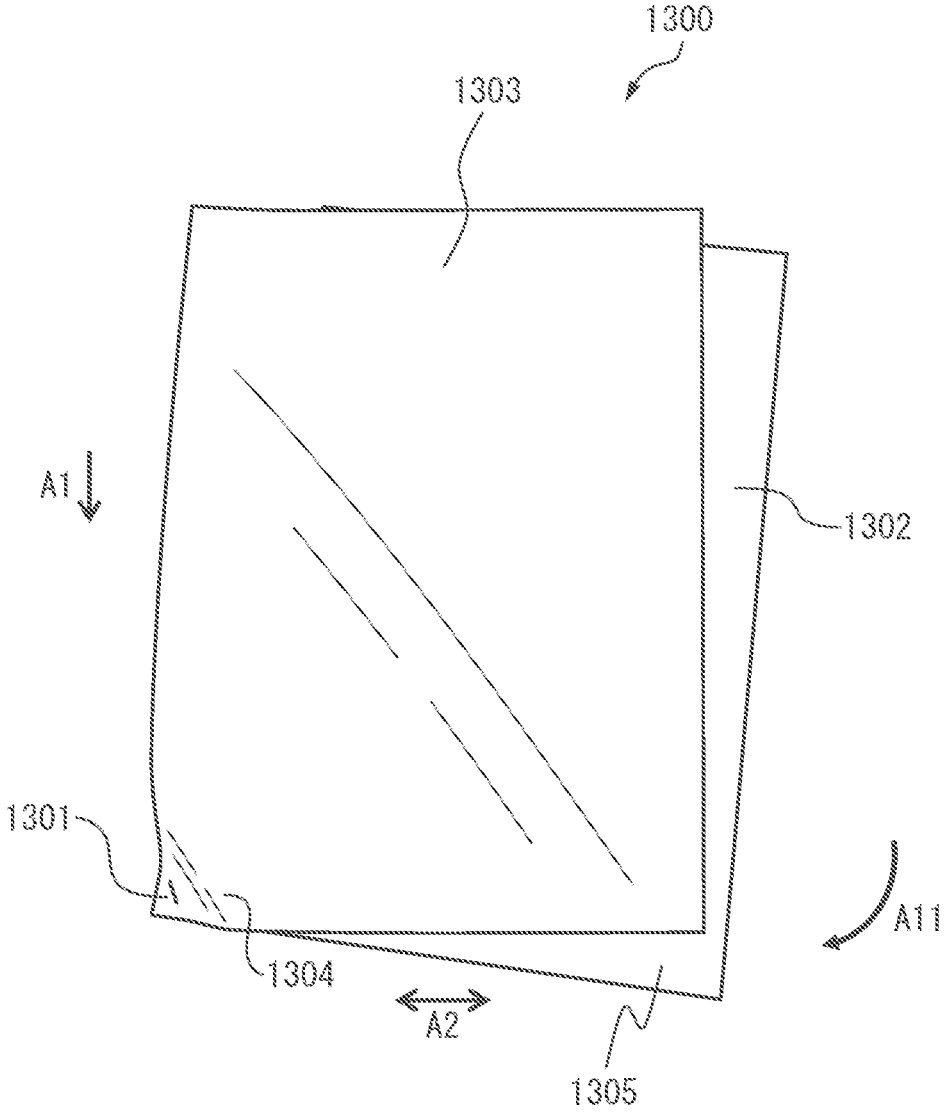
FIG. 13C is a schematic diagram illustrating a state when bound media are fed.

FIGS. 13A to 13C are schematic diagrams illustrating a state in which a plurality of media 1300 in which one corner of the media is stapled are fed in a state in which the bound portions are located on the downstream side. FIG. 13A is a schematic diagram of the medium 1300 viewed from the side of the medium conveying apparatus 100. FIG. 13B is a schematic diagram of the medium 1300 viewed from the downstream side in the medium conveying apparatus 100. FIG. 13C is a schematic diagram of the medium 1300 viewed from above. As shown in FIGS. 13A to 13C, in the medium 1300, an end portion 1301 on a downstream side in the medium conveying direction A1 and at one end side in the width direction A2 is bound.

In this case, although an upper portion 1303 attempts to remain by the brake roller 114, a force toward the downstream side is applied to the bound end 1301 by a lower portion 1302, and thereby a peripheral portion 1304 of the end 1301 of the upper portion 1303 is bent upward. On the other hand, although a downstream portion 1305 of the lower portion 1302 is fed to the downstream side of the feed roller 113, the lower portion 1302 is conveyed in an inclined manner since the bound end 1301 attempts to remain at the upstream side by the upper portion 1303. Thus, when stapled media is conveyed, both the floating and skewing of the media also occurs.

Incidentally, for example, as when a large amount of media are loaded on the medium tray 103, when a frictional force between the upper portion 1303 and the lower portion 1302 is sufficiently large, the upper portion 1303 together with the lower portion 1302 may also be conveyed to the downstream side of the feed roller 113. In that case, since the bound end 1301 is also conveyed to the downstream side, the inclination of the lower portion 1302 is small. Thus, even when the stapled media is conveyed, the floating and the multi-feed of the medium may occur. Further, when the medium 1300 reaches the feed roller 113, the upper portion 1303 may be inclined, and the inclination of the lower portion 1302 may be small. In that case, the skew of the medium is not detected, the multi-feed of the medium is detected, by the upper portion 1303 and the lower portion 1302 conveyed to the downstream side of the feed roller 113 while slightly inclined.

FIGS. 14A to 14D are schematic diagrams for illustrating a medium which is mountain folded or valley folded.

Figure 14A:
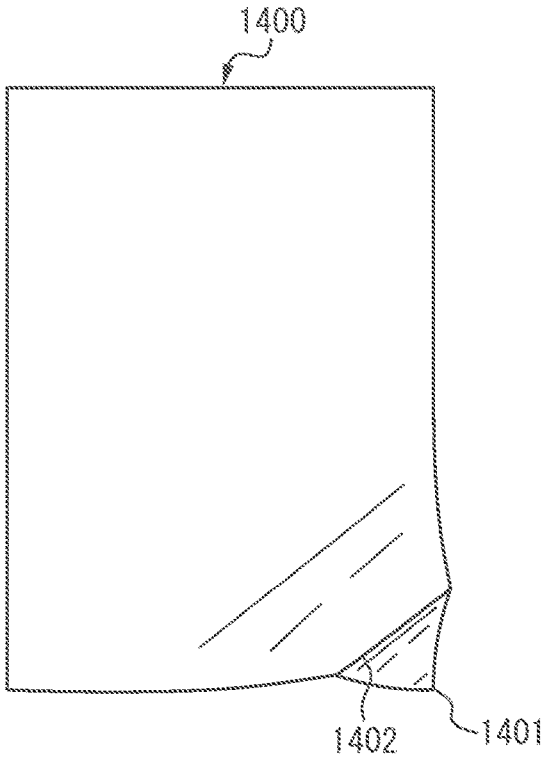
FIG. 14A is a schematic diagram illustrating a medium which is mountain folded.
Figure 14B:
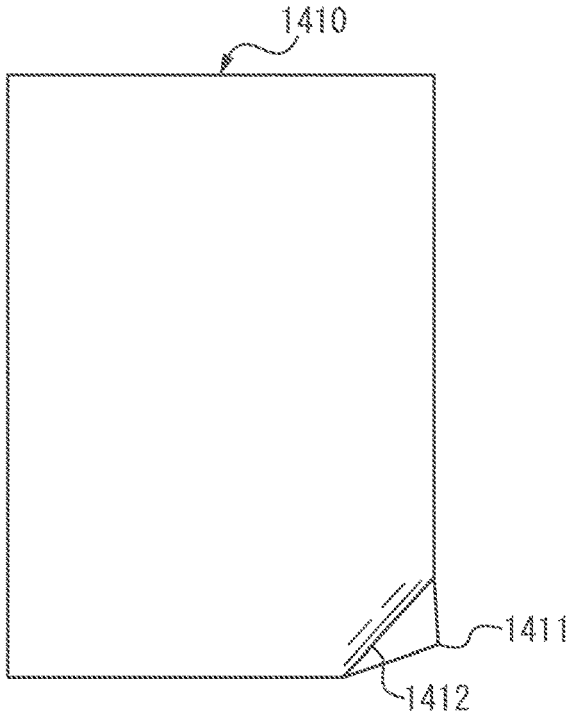
FIG. 14B is a schematic diagram illustrating a medium which is valley folded.
Figure 14C:
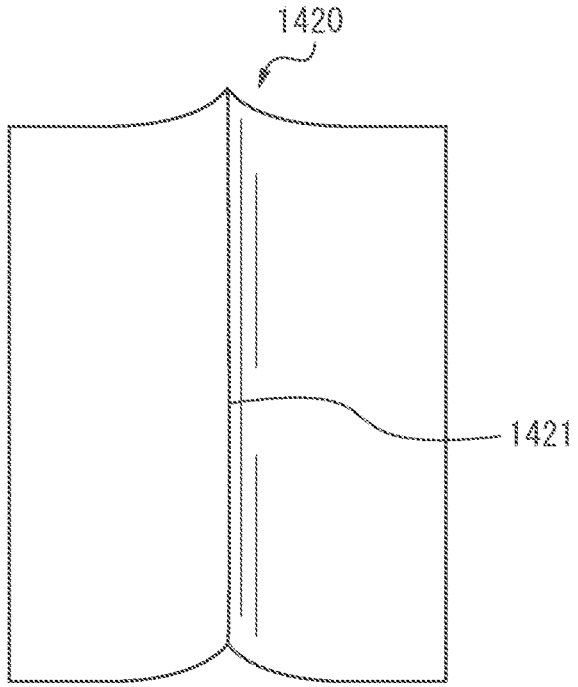
FIG. 14C is a schematic diagram illustrating a medium which is mountain folded.
Figure 14D:
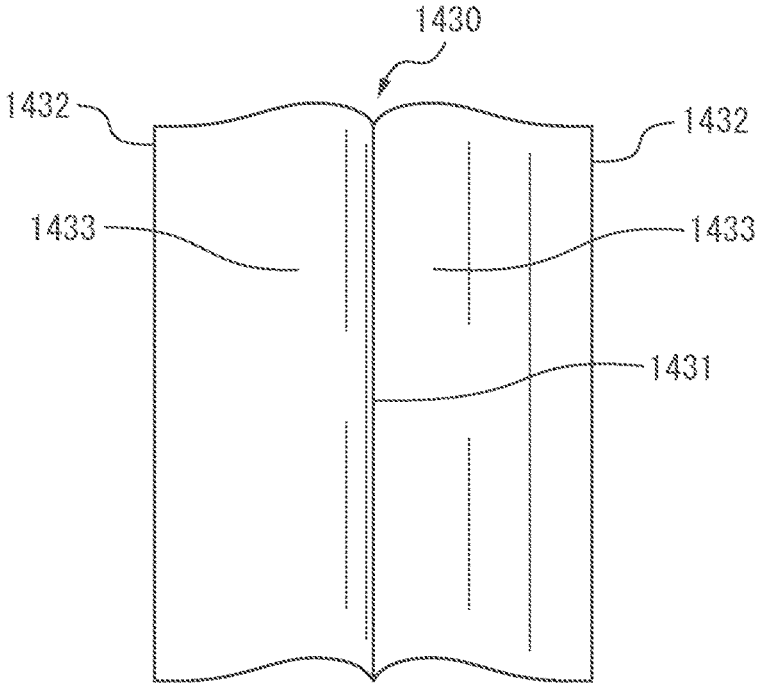
FIG. 14D is a schematic diagram illustrating a medium which is valley folded.

In a medium 1400 shown in FIG. 14A, a fold portion 1402 around a corner 1401 is in a mountain fold (folded so as to be convex upward), the fold portion 1402 is floated. In a medium 1410 shown in FIG. 14B, a fold portion 1412 around a corner 1411 is in a valley fold (folded so as to be convex downward), the corner 1411 is floated. In a medium 1420 shown in FIG. 14C, a central portion 1421 in the width direction A2 is mountain folded along the medium conveying direction A1, and the central portion 1421 is floated. In a medium 1430 shown in FIG. 14D, a central portion 1431 in the width direction A2 is valley folded along the medium conveying direction A1, a central portion 1433 between the central portion 1431 and an end portion 1432 along the medium conveying direction A1 is floated.

When these media are conveyed, although the floating of the medium occurs, the skew and the multi-feed do not occur. Further, since these media are smoothly conveyed while being guided by the lower guide 107*a* and the upper guide 107*b*, there is a low possibility that the conveyance abnormality such as the jam occurs when these media are conveyed. Therefore, the abnormality determination module 156 can accurately determine whether or not the conveyance abnormality of the medium has occurred, by further determining whether or not the skew and/or the multi-feed of the medium has occurred when the floating of the medium occurs.

As described in detail above, the medium conveying apparatus 100 determines that the conveyance abnormality of the medium has occurred when the floating of the medium occurs and the skew of the medium has occurred. Thus, the medium conveying apparatus 100 can suppress erroneous determination that the conveyance abnormality of the medium has occurred when the medium with the fold portion is conveyed. Therefore, the medium conveying apparatus 100 can more accurately determine whether or not the conveyance abnormality of the medium has occurred.

In particular, the medium conveying apparatus 100 determines that the conveyance abnormality of the medium has not occurred when the skew or the multi-feed of the medium has not occurred, no matter how large the floating of the medium is. Thus, the medium conveying apparatus 100 can suppress erroneous determination that the conveyance abnormality of the medium has occurred when a medium whose ends are bent, etc., is conveyed.

Further, the medium conveying apparatus 100 detects the floating of the medium by the first sensor 111 and the second sensor 112 located on the upstream side of the feed roller 113. Furthermore, the medium conveying apparatus 100 detects the skew of the medium by the fifth sensor 120 and the imaging device 121 located on the downstream side of the first conveyance roller 118 located on the downstream side of the feed roller 114. As described above, when the medium folded in two or the bound medium is conveyed, the floating of the medium occurs at the upstream side of the feed roller 113, and the skew of the medium occurs at the downstream side of the feed roller 113. Since such a medium starts to tilt at the feed roller 113, it is difficult to detect the skew of the medium in the vicinity of the feed roller 113. The medium conveying apparatus 100 detects the skew of the medium by the sensor located at a position sufficiently apart from the feed roller 113. Therefore, the medium conveying apparatus 100 can accurately determine whether or not the skew of the medium has occurred.

Further, in the medium conveying apparatus 100, the imaging device 121 to image the conveyed medium also serves as the skew sensor. Thus, the medium conveying apparatus 100 can reduce the number of parts, and reduce the equipment cost and device weight.

Figure 15:
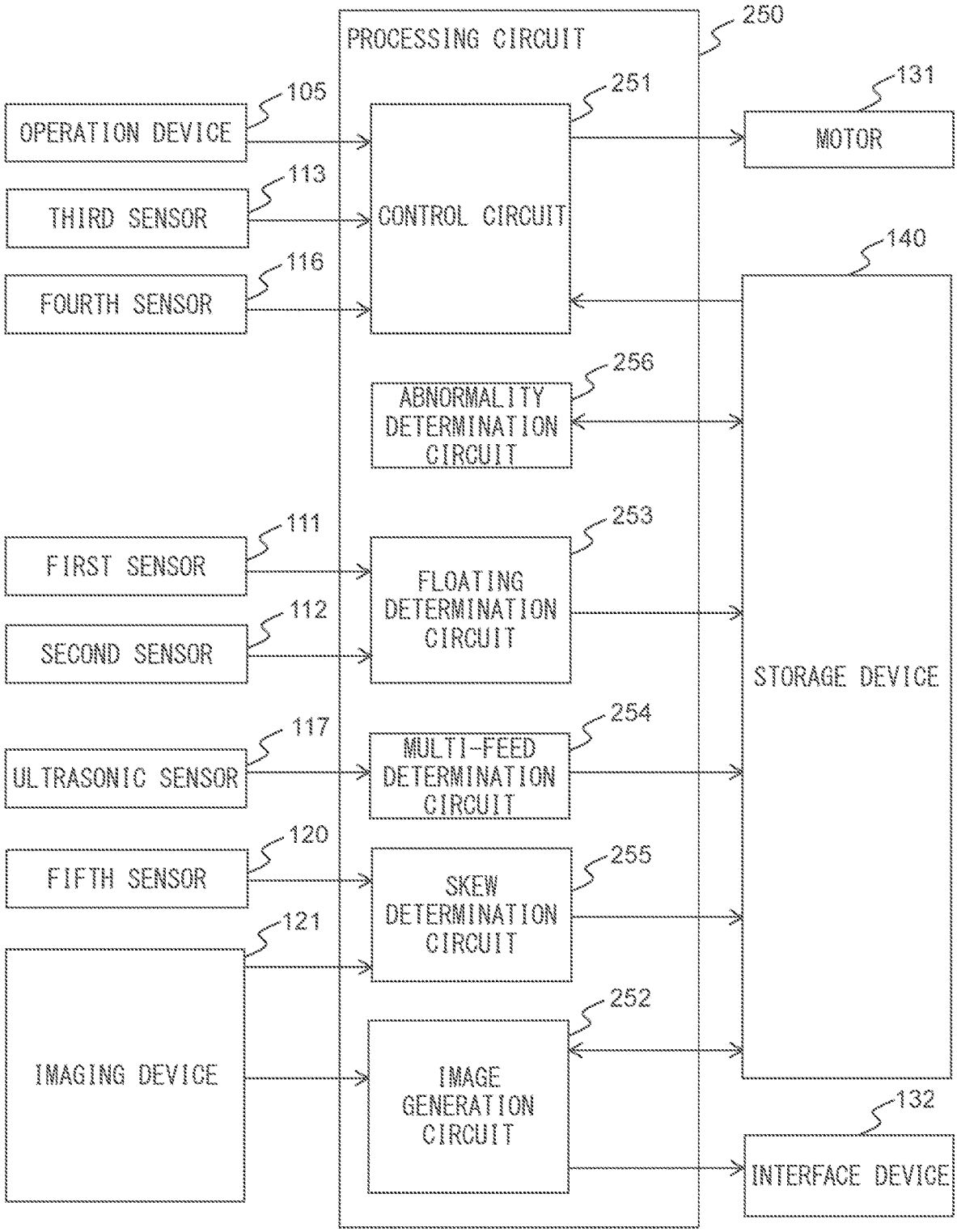
FIG. 15 is a diagram illustrating a schematic configuration of another processing circuit 250.

FIG. 15 is a diagram illustrating a schematic configuration of a processing circuit 250 in a medium conveying apparatus according to another embodiment. The processing circuit 250 is used in place of the processing circuit 150 in the medium conveying apparatus 100 and executes the medium reading processing, the floating determination processing, the multi-feed determination processing, and the skew determination processing in place of the processing circuit 150. The processing circuit 250 includes a control circuit 251, an image generation circuit 252, a floating determination circuit 253, a multi-feed determination circuit 254, a skew determination circuit 255, an abnormality determination circuit 256, etc. Note that each unit may be configured by an independent integrated circuit, a microprocessor, firmware, etc.

The control circuit 251 is an example of a control module and has a function similar to the control module 151. The control circuit 251 receives the operation signal from the operation device 105, the third medium signal from the third sensor 113, and the fourth medium signal from the fourth sensor 116, and reads the determination result of the conveyance abnormality of the medium from the storage device 140. The control circuit 251 outputs a control signal to the motor 131 so as to control the feeding and conveying of the medium in response to each information received or read.

The image generation circuit 252 is an example of an image generation module and has a function similar to the image generation module 152. The image generation circuit 252 receives the line image from the imaging device 121 to generate the input image, and stores it in the storage device 140 or transmits it to the information processing apparatus via the interface device 132.

The floating determination circuit 253 is an example of the floating determination module, and has a function similar to the floating determination module 153. The floating determination circuit 253 receives the first medium signal from the first sensor 111 and the second medium signal from the second sensor 112, and determines whether or not the floating has occurred at the end of the medium based on each received signal, and stores the floating flag in the storage device 140.

The multi-feed determination circuit 254 is an example of the multi-feed determination module and has a function similar to the multi-feed determination module 154. The multi-feed determination circuit 254 receives the ultrasonic signal from the ultrasonic sensor 117, and determines whether or not the multi-feed of the medium has occurred, based on the received ultrasonic signal, and stores the multi-feed flag in the storage device 140.

The skew determination circuit 255 is an example of a skew determination module, and has a function similar to the skew determination module 155. The skew determination circuit 255 receives the fifth medium signal from the fifth sensor 120, the line image from the imaging device 121, and determines whether or not the skew of the medium has occurred, based on each received information, and stores the skew flag in the storage device 140.

The abnormality determination circuit 256 is an example of the abnormality determination module and has a function similar to the abnormality determination module 156. The abnormality determination circuit 256 reads the floating flag, the multi-feed flag, and the skew flag from the storage device 140, and determines whether or not the conveyance abnormality of the medium has occurred based on the read flags, and stores the determination result in the storage device 140.

As described in detail above, the medium conveying apparatus can more accurately determine whether or not the conveyance abnormality of the medium has occurred even when using the processing circuit 250.

According to the embodiment, the medium conveying apparatus, the method, and the program can more accurately determine whether or not a medium conveyance abnormality has occurred.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a medium tray;

a first roller to feed by separating a medium placed on the medium tray;

a second roller located on a downstream side of the first roller in a medium conveying direction to convey the medium fed by the first roller to the downstream side in the medium conveying direction;

a floating sensor including a light sensor or a contact sensor located on an upstream side of the first roller in the medium conveying direction to detect a floating of the medium placed on the medium tray;

a skew sensor including a light sensor or an imaging sensor located on a downstream side of the second roller in the medium conveying direction to detect a skew of the medium conveyed by the second roller; and a processor to determine whether the floating of the medium has occurred based on an output signal from the floating sensor, determine whether the skew of the medium has occurred based on an output signal from the skew sensor, and determine that a conveyance abnormality of the medium has occurred, when the processor determines that the floating of the medium has occurred and the processor determines that the skew of the medium has occurred.

2. The medium conveying apparatus according to claim 1, wherein the skew sensor includes an imaging sensor to image a medium.

3. The medium conveying apparatus according to claim 1, further comprising:

an ultrasonic transmitter capable of outputting an ultrasonic wave located on the downstream side of the first roller in the medium conveying direction; and an ultrasonic receiver located facing the ultrasonic transmitter to output an ultrasonic signal corresponding to a received ultrasonic wave, wherein the processor determines whether a multi-feed of the medium has occurred, based on the ultrasonic signal, and wherein the processor determines that the conveyance abnormality of the medium has occurred when the processor determines that the floating of the medium has occurred and the processor determines that the multi-feed of the medium has occurred.

4. The medium conveying apparatus according to claim 1, wherein the first roller sequentially feeds the medium placed on the medium tray from a lower side.

5. The medium conveying apparatus according to claim 1, wherein the processor stops feeding and conveying the medium when the processor determines that the conveyance abnormality of the medium has occurred.

6. The medium conveying apparatus according to claim 5, wherein the processor once returns the medium to the medium tray, and controls the first roller to re-feed without separating when the processor stops feeding the medium.

7. The medium conveying apparatus according to claim 1, wherein the floating sensor includes a light emitter to emit light, and a light receiver to output a signal corresponding to a received light as the output signal.

8. A method for determining a conveyance abnormality of a medium, comprising:

feeding a medium placed on a medium tray, by a first roller;

conveying the medium fed by the first roller to a downstream side in a medium conveying direction by a second roller located on a downstream side of the first roller in the medium conveying direction;

detecting a floating of the medium placed on the medium tray, by a floating sensor including a light sensor or a contact sensor located on an upstream side of the first roller in the medium conveying direction;

detecting a skew of the medium conveyed by the second roller, by a skew sensor including a light sensor or an imaging sensor located on a downstream side of the second roller in the medium conveying direction;

determining whether the floating of the medium has occurred based on an output signal from the floating sensor;

determining whether the skew of the medium has occurred based on an output signal from the skew sensor;

determining that a conveyance abnormality of the medium has occurred, when it is determined that the floating of the medium has occurred and it is determined that the skew of the medium has occurred; and determining that a conveyance abnormality of the medium has not occurred, when it is determined that the floating of the medium has not occurred or it is determined that the skew of the medium has not occurred.

9. The method according to claim 8, wherein the skew sensor includes an imaging sensor to image the medium.

10. The method according to claim 8, further comprising:

outputting an ultrasonic signal corresponding to a received ultrasonic wave, by an ultrasonic receiver located facing an ultrasonic transmitter capable of outputting an ultrasonic wave located on the downstream side of the first roller in the medium conveying direction; and determining whether a multi-feed of the medium has occurred, based on the ultrasonic signal, wherein it is determined that the conveyance abnormality of the medium has occurred, when it is determined that the floating of the medium has occurred and it is determined that the multi-feed of the medium has occurred.

11. The method according to claim 8, wherein the first roller sequentially feeds the medium placed on the medium tray from a lower side.

12. The method according to claim 8, further comprising stopping feeding and conveying the medium when it is determined that the conveyance abnormality of the medium has occurred.

13. The method according to claim 12, further comprising once returning the medium to the medium tray, and controlling the first roller to re-feed without separating when stopping feeding the medium.

14. The method according to claim 8, wherein the floating sensor includes a light emitter to emit light, and a light receiver to output a signal corresponding to a received light as the output signal.

15. A computer-readable, non-transitory medium storing a computer program, wherein the computer program causes a medium conveying apparatus including a medium tray, a first roller to feed by separating a medium placed on the medium tray, a second roller located on a downstream side of the first roller in a medium conveying direction to convey the medium fed by the first roller to a downstream side in the medium conveying direction, a floating sensor including a light sensor or a contact sensor located on an upstream side of the first roller in the medium conveying direction to detect a floating of the medium placed on the medium tray, and a skew sensor including a light sensor or an imaging sensor located on a downstream side of the second roller in the medium conveying direction to detect a skew of the medium conveyed by the second roller, to execute a process, the process comprising:

determining whether the floating of the medium has occurred based on an output signal from the floating sensor, determining whether the skew of the medium has occurred based on an output signal from the skew sensor, determining that a conveyance abnormality of the medium has occurred when it is determined that the floating of the medium has occurred and it is determined that the skew of the medium has occurred; and determining that a conveyance abnormality of the medium has not occurred, when it is determined that the floating of the medium has not occurred or it is determined that the skew of the medium has not occurred.

16. The computer-readable, non-transitory medium according to claim 15, wherein the skew sensor includes an imaging sensor to image a medium.

17. The computer-readable, non-transitory medium according to claim 15, wherein the medium conveying apparatus further includes an ultrasonic transmitter capable of outputting an ultrasonic wave located on the downstream side of the first roller in the medium conveying direction, and an ultrasonic receiver located facing the ultrasonic transmitter to output an ultrasonic signal corresponding to a received ultrasonic wave, the process further comprising determining whether a multi-feed of the medium has occurred, based on the ultrasonic signal, wherein it is determined that the conveyance abnormality of the medium has occurred, when it is determined that the floating of the medium has occurred and it is determined that the multi-feed of the medium has occurred.

18. The computer-readable, non-transitory medium according to claim 15, wherein the first roller sequentially feeds the medium placed on the medium tray from a lower side.

19. The computer-readable, non-transitory medium according to claim 15, the process further comprising stopping feeding and conveying the medium when it is determined that the conveyance abnormality of the medium has occurred.

20. The computer-readable, non-transitory medium according to claim 19, the process further comprising once returning the medium to the medium tray, and controlling the first roller to re-feed without separating when stopping feeding the medium.

* * * * *